US005570961A

United States Patent [19]

Osada et al.

[11] Patent Number: 5,570,961

[45] Date of Patent: Nov. 5, 1996

[54] COLOR PRINTER FEEDING MECHANISM

[75] Inventors: Naomi Osada, Yokohama; Toshiro Kohno; Satoshi Kanbe, both of Yokosuka, all of Japan

[73] Assignee: Victor Company of Japan, Ltd., Yokohama, Japan

[21] Appl. No.: 250,237

[22] Filed: May 27, 1994

[30] Foreign Application Priority Data

| | | | |
|---|---|---|---|
| May 31, 1993 | [JP] | Japan | 5-033483 U |
| May 31, 1993 | [JP] | Japan | 5-149896 |
| Jun. 10, 1993 | [JP] | Japan | 5-165116 |
| Jul. 23, 1993 | [JP] | Japan | 5-202748 |
| Dec. 22, 1993 | [JP] | Japan | 5-346773 |

[51] Int. Cl.[6] ..... B41J 2/52

[52] U.S. Cl. ..... 400/120.04; 347/174

[58] Field of Search ..... 400/120.02, 120.04, 400/120 MP, 624, 629, 120.16, 120.17, 625, 236; 347/172, 174, 176, 177, 197, 215, 218, 220, 197, 198; 271/171, 18, 19, 21

[56] References Cited

U.S. PATENT DOCUMENTS

| | | | |
|---|---|---|---|
| 3,310,303 | 3/1967 | Schmidt | 271/21 |
| 4,395,034 | 7/1983 | Fukui | 271/21 |
| 4,751,519 | 6/1988 | Shimada et al. | 347/218 |
| 4,944,619 | 7/1990 | Suzuki et al. | 400/208 |
| 4,962,392 | 10/1990 | Okuno et al. | 347/197 |
| 4,990,933 | 2/1991 | Hatakeyama et al. | 347/174 |
| 5,035,413 | 7/1991 | Yamada et al. | 400/624 |
| 5,037,216 | 8/1991 | Nubson et al. | 400/208 |
| 5,061,099 | 10/1991 | Iwatani et al. | 400/625 |
| 5,110,106 | 5/1992 | Matsumura et al. | 271/171 |
| 5,168,287 | 12/1992 | Okunomiya et al. | 400/120.16 |
| 5,230,574 | 7/1993 | Namekawa | 400/120.16 |
| 5,297,787 | 3/1994 | Shirai | 271/171 |

FOREIGN PATENT DOCUMENTS

| | | | |
|---|---|---|---|
| 60-1554858 | 8/1985 | Japan . | |
| 60-159078 | 8/1985 | Japan . | |
| 7565 | 1/1987 | Japan | 400/120 HE |
| 62-039270 | 2/1987 | Japan | 400/207 E |
| 62-100348 | 5/1987 | Japan . | |
| 62-261464 | 11/1987 | Japan | 400/120 MP |
| 282947 | 12/1987 | Japan | 400/120 HE |
| 62-294571 | 12/1987 | Japan | 400/120 MP |
| 63-57439 | 3/1988 | Japan . | |
| 63-41555 | 3/1988 | Japan . | |
| 63-104862 | 5/1988 | Japan . | |
| 137882 | 6/1988 | Japan | 400/120 HE |
| 63-135264 | 6/1988 | Japan | 400/120 MP |
| 1-108062 | 4/1989 | Japan . | |
| 1-267080 | 10/1989 | Japan . | |
| 2-38226 | 2/1990 | Japan . | |
| 3-186529 | 8/1991 | Japan | 271/171 |
| 4-89364 | 8/1992 | Japan . | |
| 5-40233 | 5/1993 | Japan . | |
| 5-345430 | 12/1993 | Japan . | |
| 1422499 | 1/1976 | United Kingdom | 271/21 |

*Primary Examiner*—David A. Wiecking
*Attorney, Agent, or Firm*—Lowe, Price, LeBlanc & Becker

[57] ABSTRACT

A color printer comprises a recording sheet tray 3 capable of storing numerous recording sheets 2, a sheet feed/discharge roller 293 feeding an uppermost recording sheet 2 from the recording sheet tray 3 to a platen roller 7, and a clamp mechanism section 13 clamping a front end of a recording sheet 2 loaded on the platen roller 7 at a predetermined fixed position. A driving device rotates the platen roller 7 to reciprocate the loaded recording sheet 2 in forward and backward directions every time when each of plurality of color images, such as yellow (Y), magenta (M), and cyan (C), is printed on the loaded recording sheet 2. A sheet transportation path is defined between the sheet feed/discharge roller 293 and the clamp mechanism section 13 for transporting the loaded recording sheet 2 forward and backward. This sheet transportation path is shorter in length than the recording sheets 2. The sheet feed/discharge roller 293 is released, when the loaded recording sheet 2 is returned backward, from the recording sheets 2 stored in the recording sheet tray 3 so as to provide a clearance through which a rear end of the loaded recording sheet 2 reaches an X position beyond the sheet feed/discharge roller 293.

14 Claims, 31 Drawing Sheets

COLOR PRINTER FEEDING MECHANISM

BACKGROUND OF THE INVENTION

1. Field of the Invention

The present invention relates to a printer, and more particularly to a thermal transfer type color printer with a line thermal head.

2. Prior Art

Various types of printers are known which melt or sublimate color inks on a surface of a transfer sheet by a thermal head to successively apply the color inks to a recording sheet to print a color image thereon. FIG. 30 shows one of such conventional printers which comprises a clamper 403 for holding a front end portion of a recording sheet 401, a platen roller 402 for winding the recording sheet 401 held by the clamper 403, a pair of rollers 405, 406 for winding front and rear sides of the recording sheet 401, and a thermal head 408 supported by a shaft 407 to be pressed against the platen roller 402 with a transfer sheet 404 and the recording sheet 401 being interposed therebetween at the time of the printing mode. The transfer sheet 404 has color inks such as yellow, magenta, cyan and black which are successively applied thereon to be stripped in the longitudinal directions. The width of each of the ink-applied stripes substantially corresponds to that of one picture plane. Further, the thermal head 408 has a heating section comprising a plurality of heating elements successively arranged in a line in parallel with the shaft of the platen roller 402. In response to supply of a predetermined current signal, each of the plurality of heating elements causes heat simultaneously to effect a printing of an amount corresponding to one line.

In a printing operation, the recording sheet 401 fed from a sheet-feeding tray (not shown) is held on the platen roller 402 by the clamper 403, and then the platen roller 402 is rotated by a motor (not shown) while a current signal is supplied to the thermal head 408 pressed against the platen roller 402 in a state that the transfer sheet 404 is wound around the wind roller 405 by a wind motor (not shown), thereby transferring the color ink of the transfer sheet 404 onto the recording sheet 401. After completion of the first-color printing operation, the platen roller 402 is rotated at a higher speed to feed the recording sheet 401 to the recording start position, while transfer sheet 404 is wound around the wind roller 405 so that a portion having the next color ink comes into contact with the recording sheet 401 to perform the similar printing operation again. With such a printing operation being repeatedly executed with respect to the same recording sheet 401, the respective color inks on the transfer sheet 404 are overlapped on the surface of the recording sheet 401 to form a color image thereon. After completion of the printing operations by all the color inks, the thermal head 408 is raised up about the shaft 407 clockwise in the illustration to be separated from the platen roller 402 and the recording sheet 401 printed is discharged into a sheet-discharging tray (not shown), thus completing the printing operation.

However, this FIG. 30 arrangement has a disadvantage in that the diameter of the platen roller 402 becomes large with increasing size of the thermal head 408, thus increasing the cost of the printer.

FIG. 31 shows another conventional printer. In FIG. 31, a recording sheet 401 is pressed against a platen roller 402 by pairs of sheet-feeding rollers 409 and 410 without holding the recording sheet 401 with respect to the platen roller 402. For printing, the recording sheet 401 is reciprocated in back-and-forth direction by the sheet feeding rollers 409 and 410.

Although the diameter of the platen roller 402 is small, this FIG. 31 printer will encounter difficulty in accurately setting the recording sheet 401 at the recording start position in each reciprocative movement of the recording sheet 401, thus deteriorating image quality derived from positional deviation of color images.

Furthermore, FIG. 32 illustrates a conventional printer which mainly includes a clamping unit 420 for clamping one end portion of a recording sheet 401, a carrying mechanism 421 for movably supporting the clamping unit 420 in the right and left directions (generally, in the secondary scanning directions of the recording sheet) in the illustration, and a recording unit 422. The clamping unit 420 comprises a clamper 423, a substantially L-shaped pulley block 424 for conveying the clamper 423, and a solenoid 426 fixedly secured to the pulley block 424. Here, the clamper 423 is rotatably fitted to a shaft 425. References **424*a* and 424*b* are pulleys attached to the pulley block 424. The tip portion of the recording unit 422 side of the clamper 423 is bent so as to appropriately clamp the recording sheet 401 and the other end portion thereof has the solenoid 426 which rotates the clamper 423. Furthermore, the carrying mechanism 421 comprises drive pulleys 436 and 437, a belt 428 stretched between the drive pulleys 436 and 437, and others. The belt 428 is disposed at the lower portion of the clamping unit 420 so as to be driven through belts b and c by means of a motor 427 fixed to the recording unit 422. The pulley block 424 is fixedly secured to the belt 428. Furthermore, below the belt 428 there is disposed a stage 429 for allowing the pulleys 424*a* and 424*b* fixed to the pulley block 424 to move in the secondary scanning directions of the recording sheet 401. The pulleys 424*a* and 424*b* are moved by means of an adequate mechanism (not shown). On the stage 429 there is provided a reflection type positioning sensor 430 which serves as detecting means for determining the original point (i.e recording start point) of the pulley block 424. When the motor disposed in the recording unit 422 is driven, the motor's power is transmitted to the platen roller 402 and the sheet-feeding rollers 409 and 410. These sheet-feeding rollers 409 and 410 guide the recording sheet 401 fed. Here, the feeding roller 409 is urged toward the feeding roller 410 by means of an appropriate mechanism (not shown) to slide on the recording sheet 401. Furthermore, on the feeding roller 410 attached to a fixed shaft, there is provided a one-way clutch whereby the recording sheet 401 is movable only in one direction. In the motor 427 there is provided an encoder, and rotation of the motor 427 is controlled with motor driver receiving a predetermined number of pulses from the encoder. The feeding roller 410 is arranged to be rotatable at a lower speed than the drive pulley 437 by changing the gear ratio so as to prevent the recording sheet 401 from being loosen on the travelling path. The platen roller 402 is disposed between the carrying mechanism 421 and feeding rollers 409, 410 to receive pressure applied to the thermal head 408. The thermal head 408 is arranged to be rotatable about a shaft 407 and is pressed against the platen roller 402 by rotation of an eccentric cam 431 so that pressure is evenly applied to the heating portion of the thermal head 408. Above the thermal head 408 there are provided a pair of transfer sheet rollers 405 and 406 for winding a transfer sheet 404. An intermediate portion of the transfer sheet 404 wound around the transfer sheet rollers 405 and 406 is disposed between the thermal head 408 and the platen roller 402. Reference numerals 432 and 433 are guide rollers provided at the front and the rear sides of the platen roller 402 for causing the transfer sheet 404** to smoothly travel.

According to the FIG. 32 conventional printer, in the reciprocative movement of the recording sheet 401, the recording sheet 401 is so accurate in positioning the recording start point to provide high-quality image and the diameter of the platen roller 402 can be reduced to allow using a small-sized thermal head 408 for cost reduction of the printer. However, this arrangement requires the carrying mechanism 421 for allowing the accurate positioning of the recording sheet 401. The provision of the carrying mechanism 421 increases the size and cost of the printer.

SUMMARY OF THE INVENTION

Accordingly, in view of above-described problems encountered in the prior art, an object of the present invention is to realize a compact size by shortening the length of a sheet transportation path, using the sheet transportation path commonly for both feeding and discharging a recording sheet, using a single driving source for a plurality of driving mechanisms, and minimizing sizes of sensors. Furthermore, the present invention has a purpose of removing deflection or inclination of the recording sheet with simple construction. Other object is to realize simplified constructions in providing various components, such as an adjustable recording sheet pressing means, a single roller for feeding and discharging the recording sheet, a recording sheet separating means, a guide plate, a thermal head mechanism easily exchangeable, and a recording sheet tray whose size is adjustable.

In order to accomplish above and other related objects, one aspect of the present invention provides a recording apparatus comprising: recording sheet tray means for storing recording sheets of various types; sheet feed roller means for pressing an uppermost recording sheet stored in said recording sheet tray means and feeding said uppermost recording sheet from said recording sheet tray means to a platen roller; clamp means for clamping a front end of a recording sheet loaded on said platen roller at a predetermined fixed position; driving means for rotating said platen roller to cause a reciprocative movement of the loaded recording sheet in forward and backward directions each time one of a plurality of color images is printed on said loaded recording sheet; a sheet transportation path defined between said sheet feed roller means and said clamp means for transporting said loaded recording sheet forward and backward, said sheet transportation path being shorter in length than said recording sheets; said sheet feed roller means being released, when said loaded recording sheet is returned backward, from said recording sheets stored in said recording sheet tray means so as to provide a clearance through which a rear end of said loaded recording sheet reaches a position beyond said sheet feed roller means.

The clamp means includes a movable clamp section and a stationary clamp section, and a first drive mechanism moves said movable clamp section from a clamp position where said movable clamp section is pressed against said stationary clamp section and a retracted position where said movable clamp section is released from said stationary clamp section, and a second driving mechanism presses and releases said sheet feed roller means against and from said recording sheets stored in said recording sheet tray means.

The first and second driving mechanisms are actuated by a common driving source.

The movable clamp section is positioned at said retracted position when said sheet feed roller means is pressed against said recording sheets stored in said recording sheet tray means, and said movable clamp section is positioned at said clamp position when said sheet feed roller means is released from said recording sheets stored in said recording sheet tray means during recording operations, and said movable clamp section is positioned at said retracted position when said platen roller discharges said loaded recording sheet.

The recording apparatus further comprises a supply core and a wind core cooperatively winding a transfer sheet, a cartridge installing said supply core and said wind core, a plurality of discriminating marks provided on said cartridge, and transfer sheet discriminating means for discriminating type of said transfer sheet by detecting said discriminating marks on said cartridge.

The discriminating marks are pins, and said transfer sheet discriminating means includes actuator switches which are turned on depending on presence of said pins.

The recording apparatus further comprises: a cartridge accommodating a supply roller and a wind roller cooperatively winding a transfer sheet; a thermal head mechanism section rotated by a rotating means from a predetermined position close to said platen roller to a retracted position when said cartridge is removed from said recording apparatus; a rewind mechanism section for rewinding said supply roller; a wind mechanism section, connected through a torque limiter to a drive shaft of a motor, for winding said winding roller; and connecting means for connecting said rewind mechanism section to said drive shaft of said motor, when said thermal head mechanism section is in the retracted position.

After said clamp means clamps said recording sheet, said platen roller is rotated so as to cause reciprocative movement of said recording sheet before initiating recording operations.

After finishing one recording operation for one color, said platen roller is reversely rotated as much as a forward sheet feeding amount for said one recording operation, and is further added additional reverse rotations by the rotation number equal to an integer not less than 1.

The recording apparatus further comprises: platen roller driving means; and a speed-reduction mechanism interposed between said platen roller driving means and said platen roller, said speed-reduction mechanism having a reduction ratio of a reciprocal of a positive integer more than 1.

The speed-reduction mechanism comprises large and small pulleys and a timing belt entrained between said pulleys, and a ratio of said timing belt to said small pulley in teeth number is a positive integer more than 1. The platen roller is reversely rotated, after finishing one recording operation for one color, as much as a forward sheet feeding amount for said one recording operation, and is further reversely rotated by the rotation number defined by $$LCM\left(\frac{LCM(P_1, T_1)}{P_1}, \frac{LCM(P_n, T_n)}{P_n}\right)$$

where, $LCM(N_1, N_2)$ represent a least common multiple of integers $N_1$ and $N_2$, $P_n$ represent a teeth number of said large pulley and $T_n$ represents a teeth number of said timing belt, and n represents the number of sets of pulleys and a timing belt.

The recording apparatus further comprises recording sheet pressing means for pressing said recording sheet against said platen roller. This recording sheet pressing means serves as a guide member defining said sheet transportation path, and position of said recording sheet pressing means is adjustable with respect to said platen roller.

The recording sheet pressing means presses said recording sheet against said platen roller through an elastic member having frictional coefficient smaller than said platen roller.

The recording apparatus further comprises: recording sheet separating means for separating said uppermost recording sheet from said recording sheet tray means; a sheet discharge guide plate extending from said clamp means to said sheet feed roller means, said sheet discharge guide plate not only defining a sheet discharge path but serving as an upper regulating plate of said sheet transportation path; and a cutout portion provided on said sheet discharge guide at a region corresponding to said recording sheet separating means.

The recording apparatus further comprises: follower roller means pressing said sheet feed roller means; a guide plate for guiding said recording sheet to a contact point between said follower roller means and said sheet feed roller; and a flat elastic member giving pressing force to said follower roller means, said flat elastic member having one surface confronting with said guide plate to define a sheet discharge path.

The recording apparatus further comprises: a thermal head being pressed against or released from said platen roller; a rotation member having a central hole and being provided rotatably on a rear surface of said thermal head; and a pressing member being threaded into said central hole of said rotation member, so as to move said thermal head toward said platen roller by causing rotation between said rotation member and said pressing member.

The recording apparatus further comprises: a pressing member for moving said thermal head toward said platen roller, said pressing member having a neck portion; and photo detecting means for detecting said neck portion together with said pressing member itself to judge position of said pressing member.

The recording apparatus further comprises bearing means for rotatably supporting said thermal head, so as to press against or release from said platen roller; and said bearing means including a steel ball, spring means for biasing said steel ball toward said thermal head, and a supporting hole provided on said thermal head for receiving said steel ball.

The recording sheet tray means includes: a length regulating plate slidable in a longitudinal direction with a rear end regulating member; a roller rotatably supported at a lateral end of said length regulating plate; a width regulating plate having an edge being brought into contact with said roller, said edge having a recess engageable with said roller so as to vary width of said recording sheet tray means in response to slide movement of said length regulating plate; and size detecting means for discriminating size of the recording sheet by detecting position of said length regulating plate.

BRIEF DESCRIPTION OF THE DRAWINGS

The above and other objects, features and advantages of the present invention will become more apparent from the following detailed description which is to be read in conjunction with the accompanying drawings, in which:

FIGS. 18(A) to 18(C) show a transfer sheet discriminating means, wherein FIG. 18(A) corresponds to a type 1 transfer sheet, FIG. 18(B) corresponds to a type 2 transfer sheet, and FIG. 18(C) corresponds to a type 3 transfer sheet;

DETAILED DESCRIPTION OF THE PREFERRED EMBODIMENT

Figure 1:
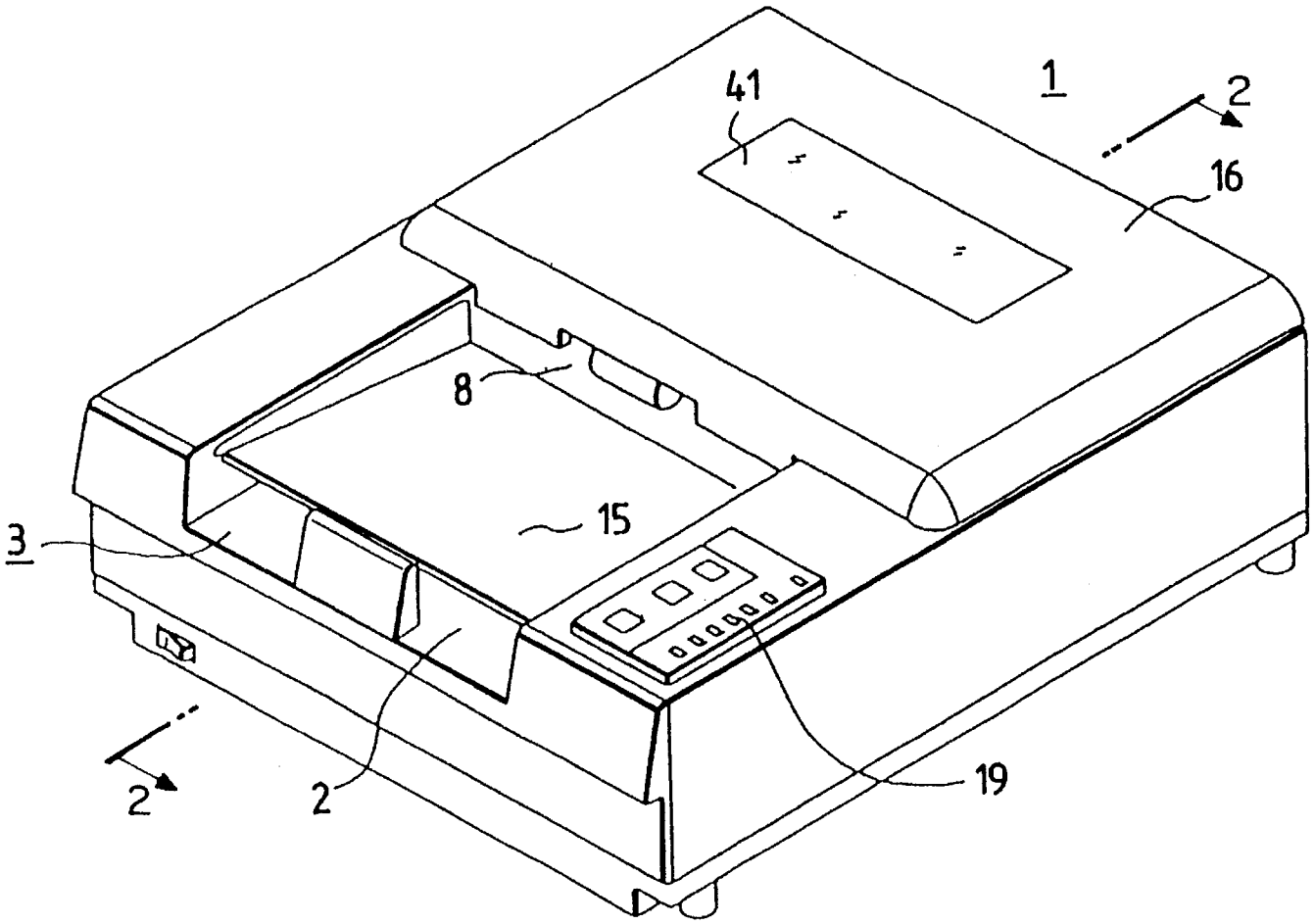
FIG. 1 is a schematic perspective view showing a color printer in accordance with one embodiment of the present invention.

Hereinafter, a preferred embodiment of the present invention will be explained in detail with reference to the accompanying drawings. Some of components are constituted by a pair of parts (whose reference numerals are suffixed by R or L) having identical or symmetrical configuration with each other, although the drawings may omit either of them by illustrating at least the other of them.

Figure 2:
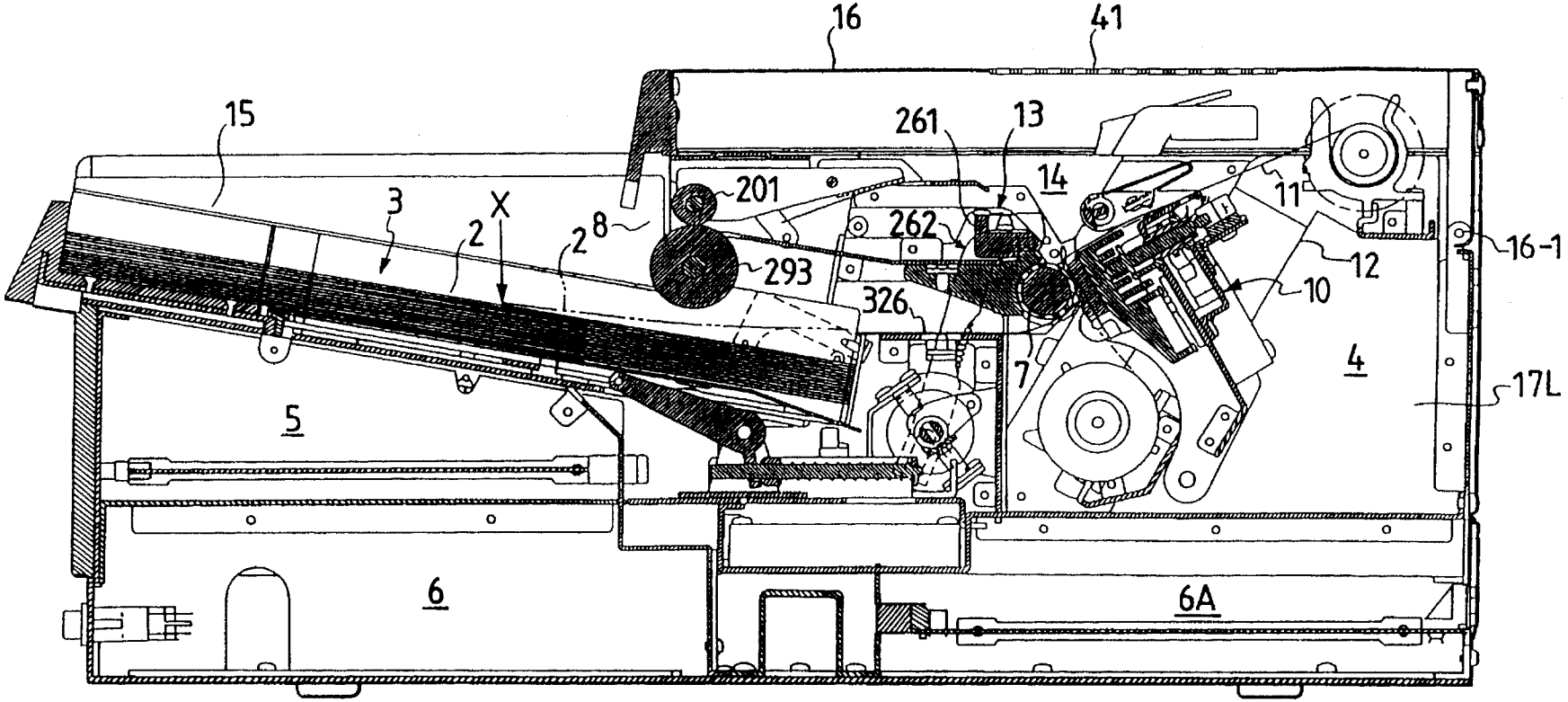
FIG. 2 is a vertical cross-sectional view taken along a line A—A of FIG. 1.
Figure 3:
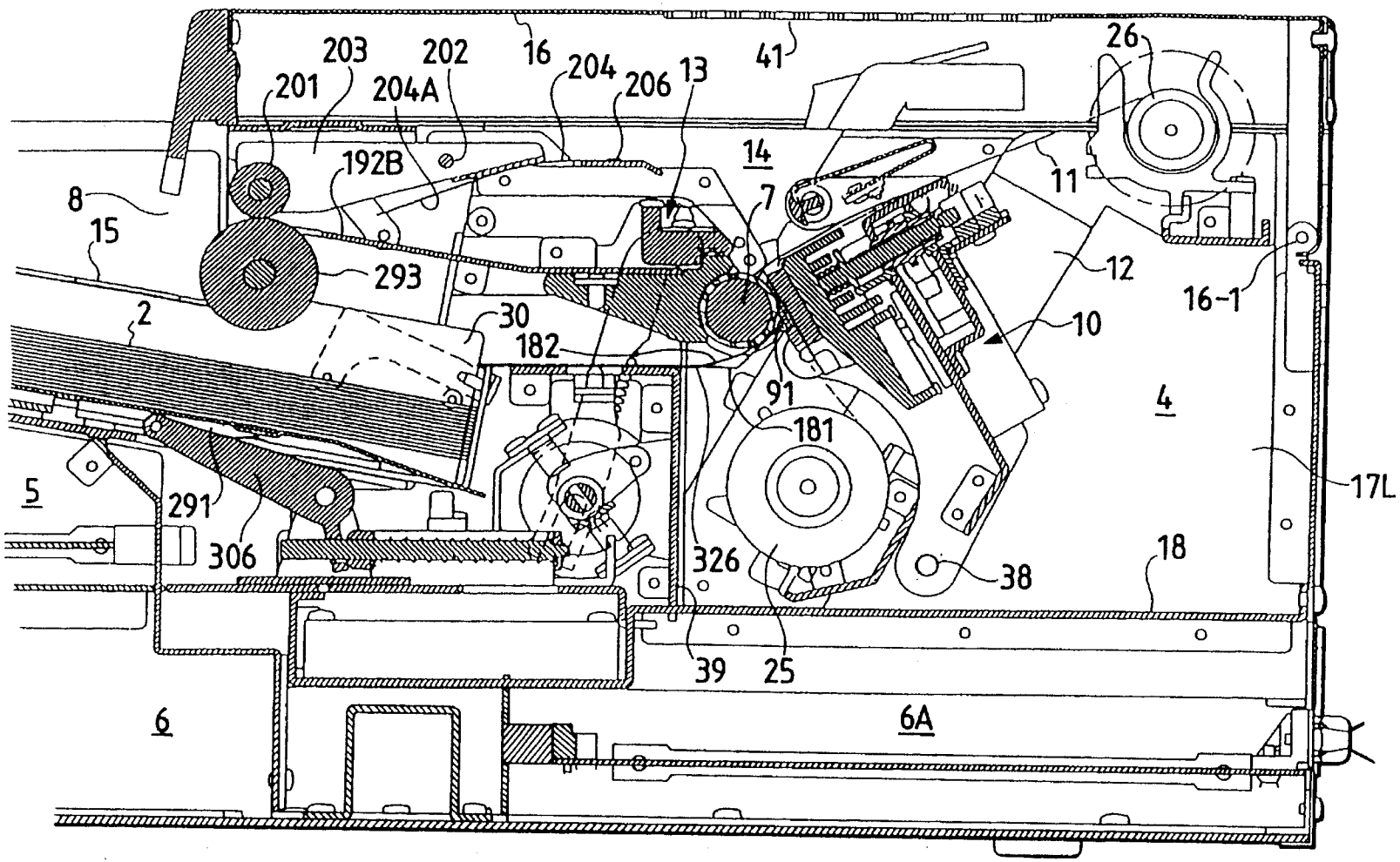
FIG. 3 is a partially enlarged view of FIG. 2.

FIG. 1 is a schematic perspective view showing a color printer (hereinafter referred to as "printer"), FIG. 2 is a vertical cross-sectional view showing of FIG. 1 taken along a line A—A, and FIG. 3 is a partially enlarged view of FIG. 2. FIGS. 2 and 3 are illustrations showing a condition where a thermal head mechanism portion is engaged or brought into contact with a platen roller. As shown in these drawings, the printer 1 has substantially a stepped contour and stores a number of recording sheets 2 piled up in a recording sheet tray 3 provided at a front end thereof. A central portion of the printer 1 is occupied with a mechanism section 4 including a main recording mechanism, while a bottom of the printer 1 provides a space for a signal processing circuit section 5, an electric power source & mechanism control circuit section 6 and an I/F circuit section 6A.

More specifically, the mechanism section 4 comprises a thermal head mechanism section 10, a transfer sheet 11 held in a cartridge 12, a clamp mechanism section 13 clamping the recording sheet 2, and a reservoir section 14 temporarily reserving the recording sheet 2 during a recording operation.

A cover 15 is provided detachably on the recording sheet tray 3, so as to facilitate supply or addition of the recording sheets 2. A cover 16, provided above the cartridge 12 and the reservoir section 14, is swingably supported by a hinge 16-1 so as to be opened when the cartridge 12 is exchanged or the recording sheet jammed needs to be removed from the reservoir section 14. A window 41 with a transparent plate allows observing the inside of printer 1 for checking condition of the recording sheet 2 in the reservoir section 14.

The printer 1 includes a platen roller 7 rotatable in both forward and reverse directions so as to cause reciprocative movement of the recording sheet 2 in back-and-forth direction in response to the rotation of such a platen roller 7. Color inks such as three colors of yellow (Y), magenta (M), and cyan (C) or four colors of above three plus black (B) are successively applied on the recording sheet 2 in an overlapping manner in synchronization with the reciprocative movement of the platen roller 7. To prevent dirt or dust from adhering on the recording sheet 2, consideration should be given to the arrangement or movement of the recording sheet 2 so that the recording sheet 2 does not go out of the housing of the printer 1 before finishing such repetitive recording operations using designated plural colors. A display panel 19 is provided on the upper surface of the printer 1 to indicate conditions of the printer 1.

Figure 4:
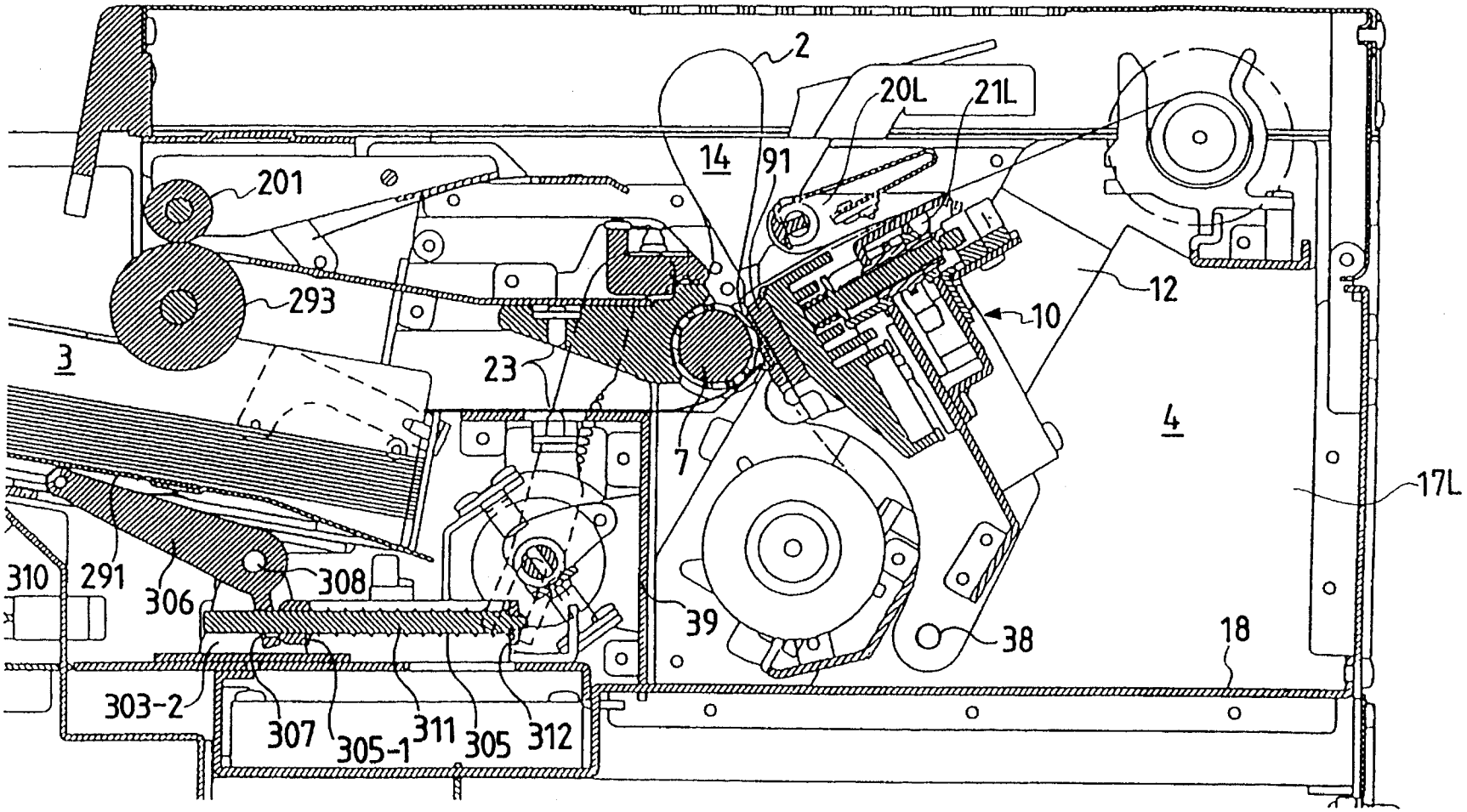
FIG. 4 is a vertical cross-sectional view showing a recording operation of the printer.
Figure 5:
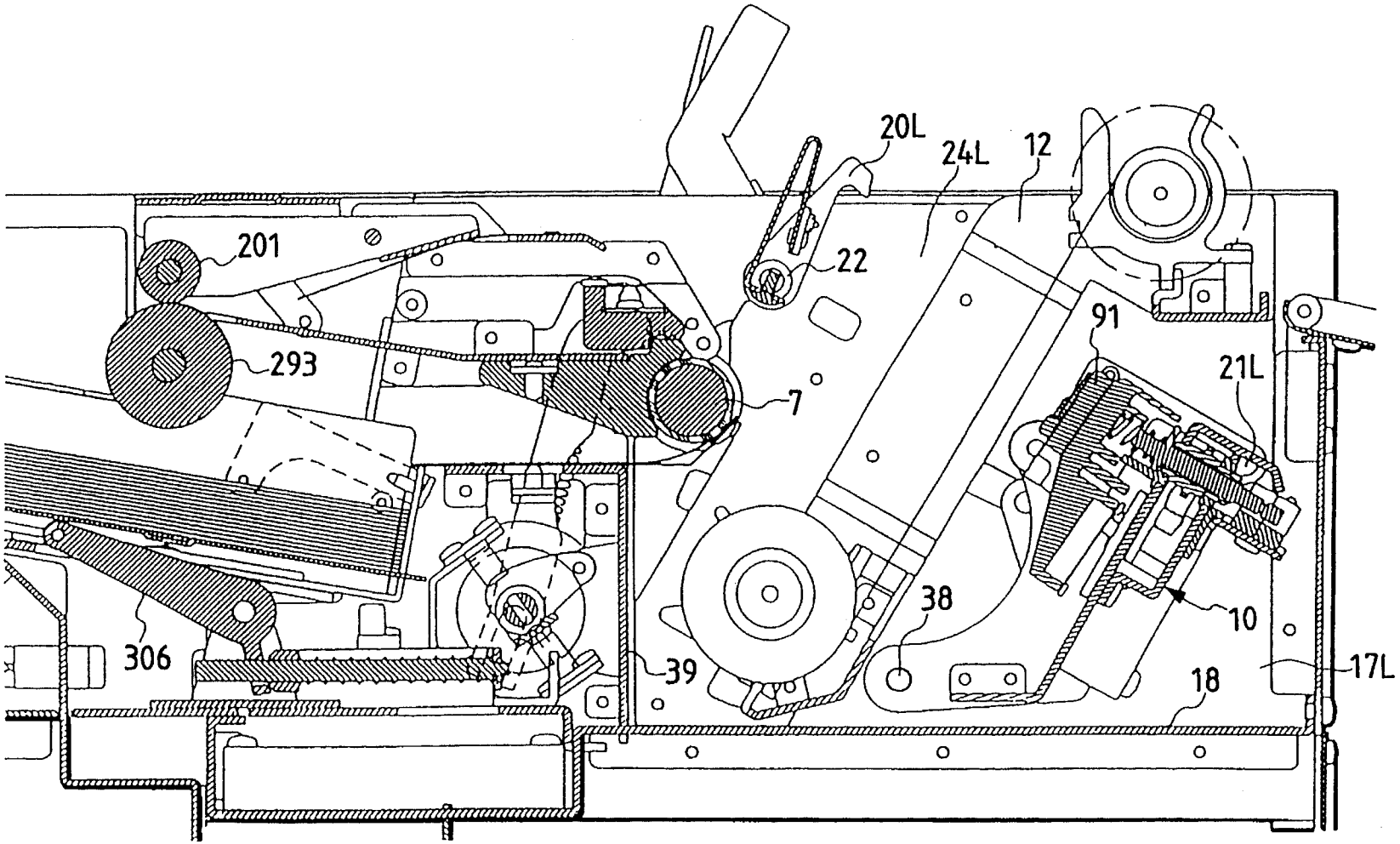
FIG. 5 is a vertical cross-sectional view showing a retracted condition of a thermal head mechanism section.
Figure 6:
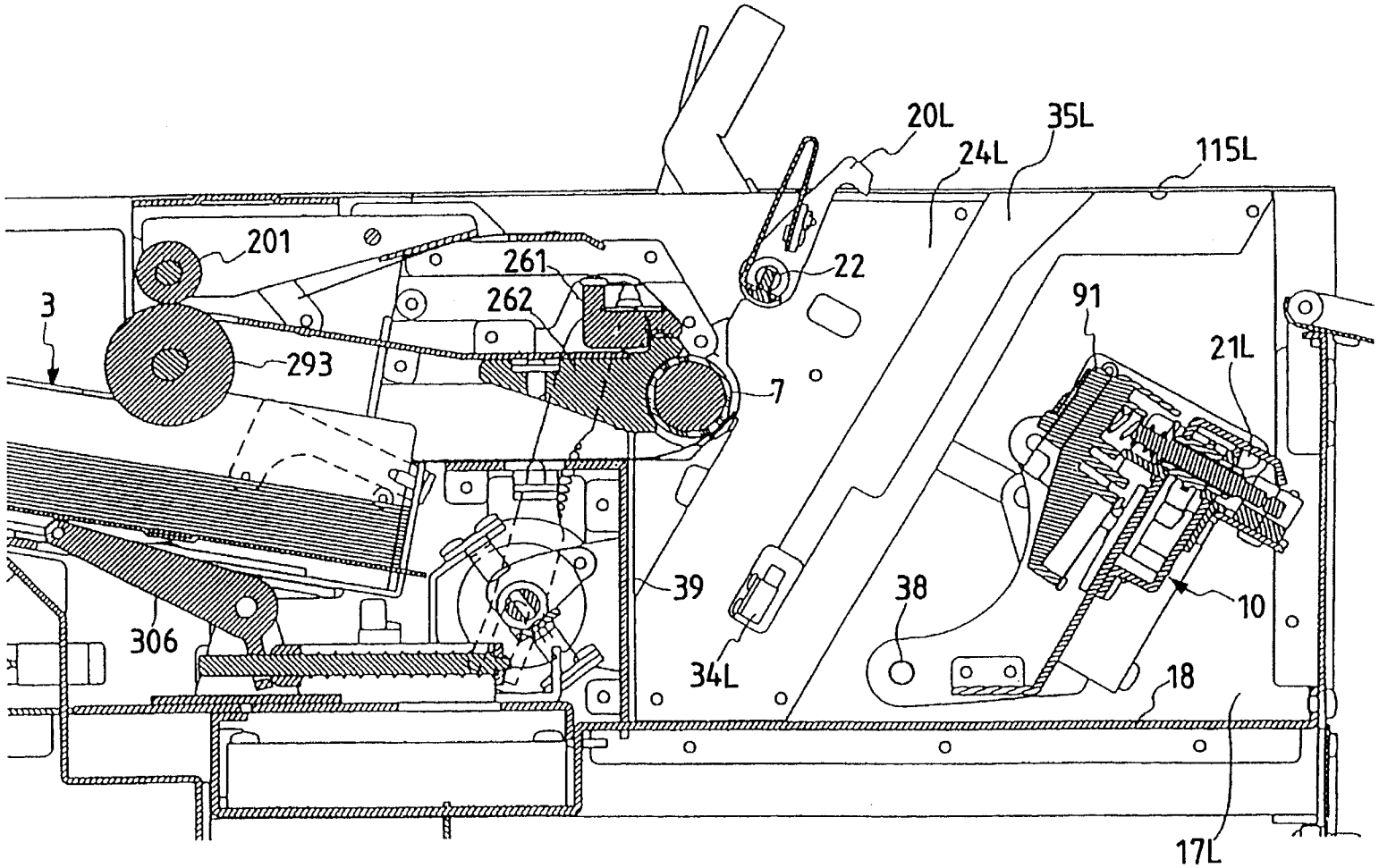
FIG. 6 is a vertical cross-sectional view showing a condition where a cartridge is removed.

The mechanism section 4 will be explained in more detail with reference to FIGS. 4 to 6. FIG. 4 shows a condition where the recording sheet 2 is reserved in the reservoir section 14 during the recording operation. FIG. 5 shows a retracted condition of the thermal head mechanism section 10 wherein the thermal head mechanism section 10 is raised or rotated in a clockwise direction about a shaft 38. Furthermore, FIG. 6 shows another condition where the cartridge 12 is removed in the retracted condition of FIG. 5.

The mechanism section 4 is supported by right and left aluminum die-casting frames 17R and 17L, a stay 18 connecting these right and left frames 17R and 17L, and an L-shaped stay 39.

The thermal head mechanism section 10 is rotatable about the shaft 38. When the thermal head mechanism section 10 is positioned at a setting or operating position where the thermal head mechanism section 10 is brought into contact with the platen roller 7, the thermal head mechanism section 10 is fixed by fixing claws 20R, 20L engaging with fixing pins 21R, 21L provided at both sides of the thermal head mechanism section 10.

These fixing claws 20R, 20L are integrally secured to a shaft 22, so as to cause a rotational motion together with the shaft 22. These fixing claws 20R, 20L are disengaged from the fixing pins 21R, 21L by means of a lock release mechanism (not shown), so as to rotate the fixing claws 20R, 20L in a counterclockwise direction in the drawing.

Rails 24R and 24L constitute guide for the cartridge 12 detachably engaged with the frames 17R, 17L. More specifically, when the thermal head mechanism section 10 is in a retracted position where the thermal head mechanism section 10 is raised or rotated in the clockwise direction in the drawing spaced from the platen roller 7, the cartridge 12 is loaded or removed along these rails 24R, 24L extending in an up-and-down direction.

Figure 13:
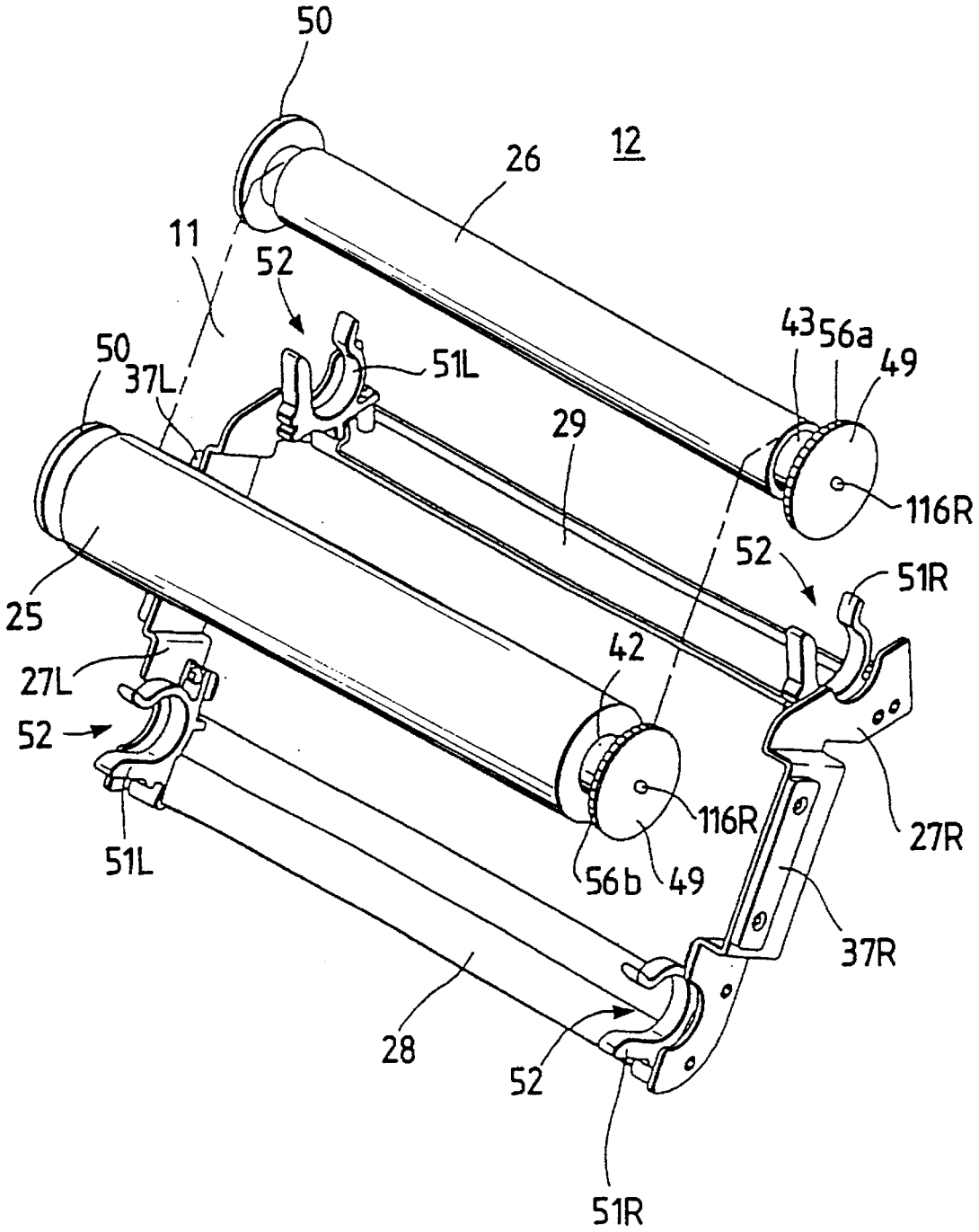
FIG. 13 is an exploded perspective view showing the cartridge.

Next, the cartridge 12 will be explained with reference to FIG. 13. The cartridge 12 comprises a supply roll 25, a wind roll 26, stays 28, 29, geared flanges 49, 49, non-geared flanges 50, 50, bearings 51R, 51R, 51L, 51L, respectively having an opening 52, a wind roll gear 56*a*, a supply roll gear 56*b*, guides 37R, 37L, and pins 116R, 116R. Right and left frames 27R and 27L, connected by the stays 28 and 29, define the framework of the cartridge 12. The guides 37R, 37L are fixed on the outer sides of these right and left frames 27R and 27L, respectively. These guides 37R, 37L engage with grooves 35R, 35L formed on the rails 24R, 24L of the frames 17R, 17L shown in FIG. 6, respectively, so as to cooperatively guide the cartridge 12 for loading or removal.

The supply roll 25 has a cylindrical supply core 42, while the wind roll 26 has a cylindrical wind core 43. A transfer sheet 11 is wound around these cylindrical cores 42, 43. The geared flanges 49, 49 are inserted into right bores of these cylindrical cores 42, 43, so as to be integrated with these cylindrical cores 42, 43.

Installation of the supply roll 25 and the wind roll 26 to the framework of the cartridge 12 is carried out using the bearings 51R, 51L. These bearings 51R, 51L are respectively made of a C-shaped resilient member having one opening 52 for facilitating installation of the core 42 or 43 and a round bearing portion for rotatably supporting the core 42 or 43 therein. The opening 52 has a gap slightly narrower than the corresponding diameter of the supply core 42 or the wind roller 43. When the supply core 42 or the wind core 43 is pressed against the opening 52, the bearing 51R or 51L causes resilient deformation for widening the gap of the opening 52, thus allowing the core 42 or 43 to enter and locate in the bearing 51R or 51L. After installed in the paired bearings 51R, 51L, right and left sides of the core 42 or 43 are restricted by the geared flange 49 and the non-geared flange 50 not to cause a right-and-left movement.

Figure 14:
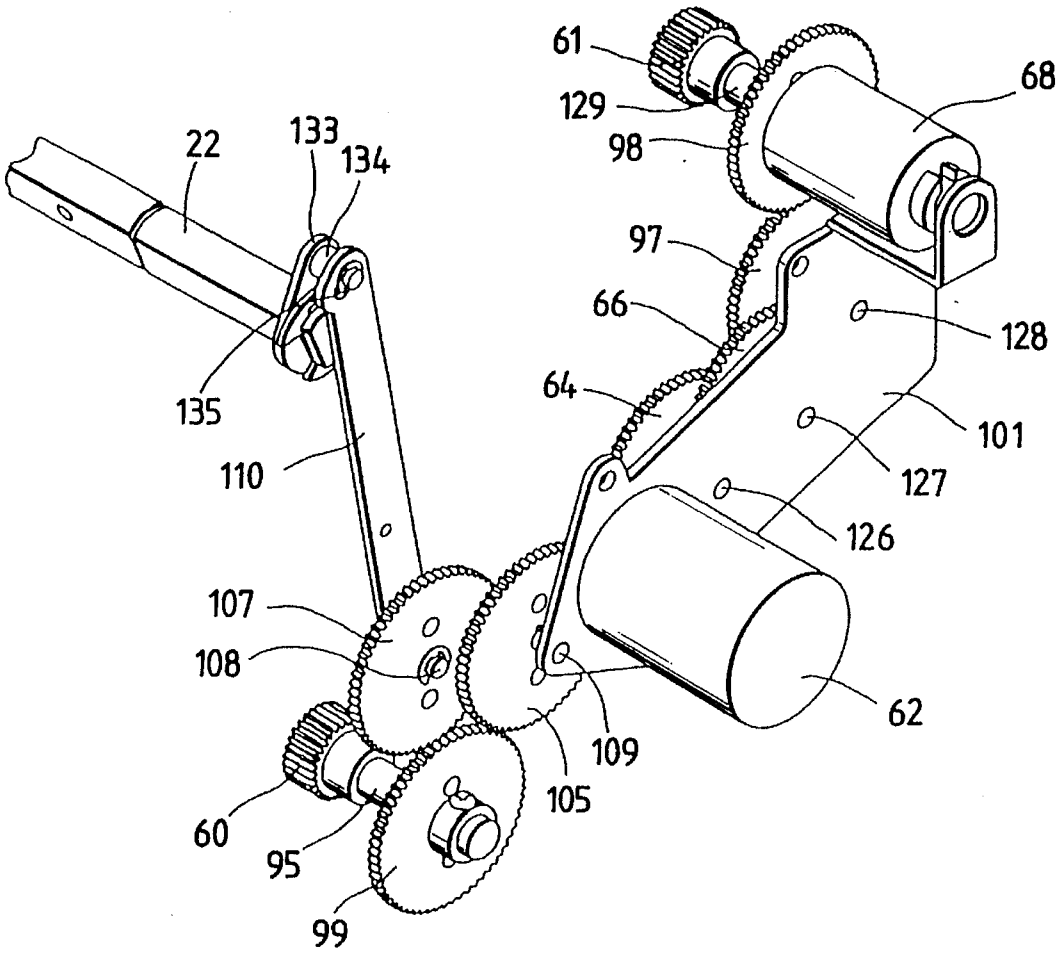
FIG. 14 is a view showing a driving system for winding/rewinding a transfer sheet.
Figure 15:
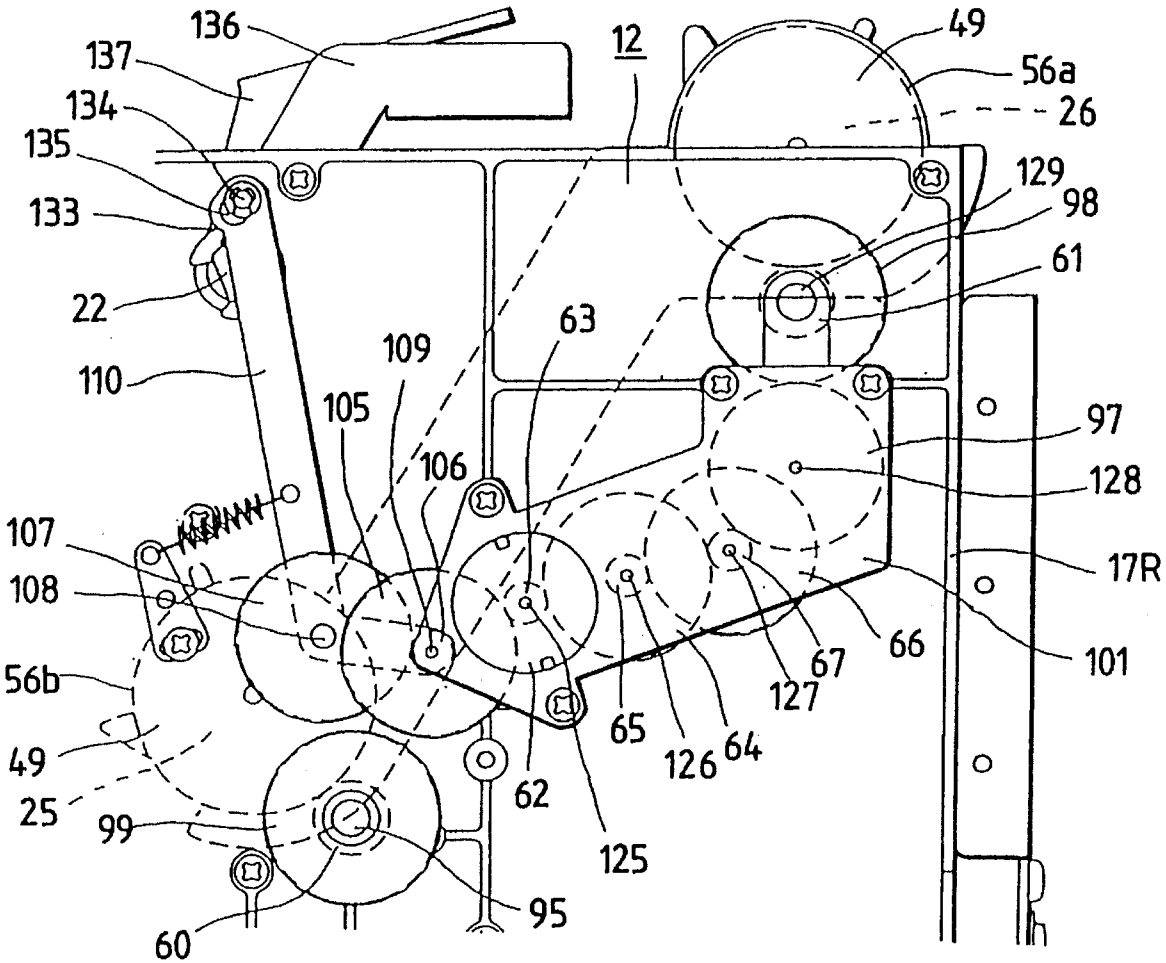
FIG. 15 is a side view showing the driving system of FIG. 14.

Loading of the cartridge 12 to a predetermined position in the printer 1 only requires coupling the guides 37R, 37L protruding outwardly from the right and left flanges 27R, 27L of the cartridge 12 into the grooves 35R, 35L formed on the right and left rails 24R, 24L of FIG. 6, thus allowing the cartridge 12 to fall along the grooves 35R, 35L. When the cartridge 12 reaches the predetermined position, the pins 116R, 116L protruding outwardly from the flanges 49, 50 are positioned in the recesses 115R, 115L formed on the rails 24R, 24L of FIG. 6. Simultaneously, a wind gear 61 shown in FIGS. 14, 15 is meshed with the wind roll gear **56*a* formed on the flange 49 press-fitted into the wind core 43. Meanwhile, a looseness-eliminating gear 60 is meshed with the supply roll gear 56*b* formed on the flange 49 press-fitted into the supply core 42**.

Upon completing the loading of the cartridge 12, the pins 116R, 116L protruding outwardly from the flanges 49, 50 of the supply core 42 enables making a judgement as to type of the transfer sheet 11. More specifically, these pins 116R, 116L depress actuators of detecting switches 34R, 34L provided at the bottom of the grooves 35R, 35L of the rails 24R, 24L.

Figure 16A:
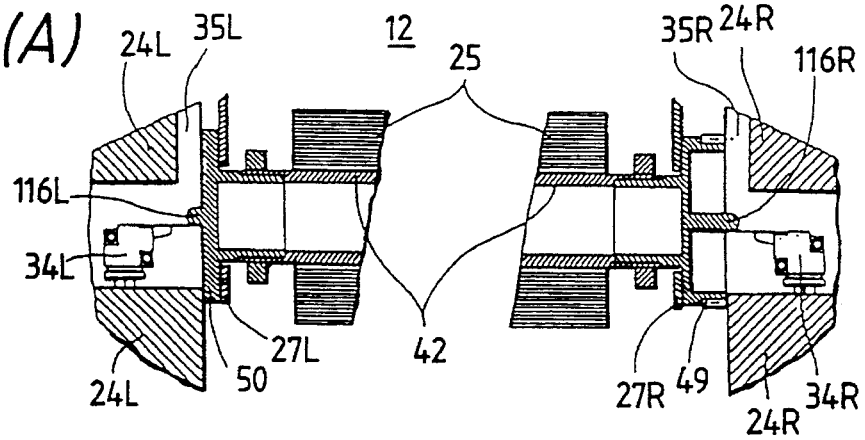
Figure 16B:
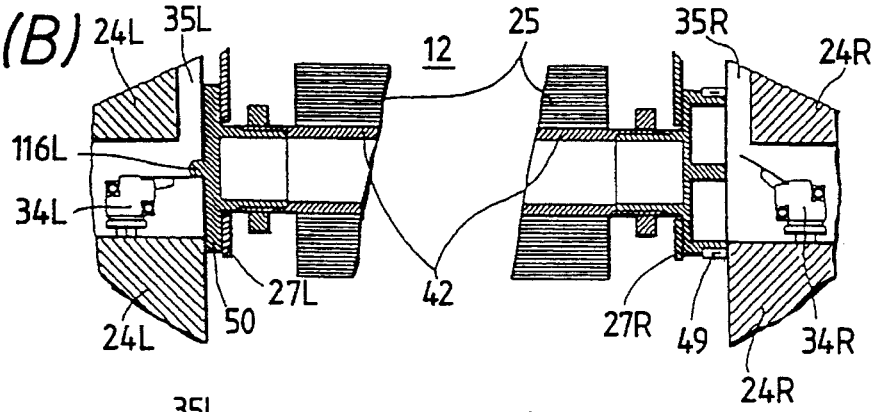
Figure 16C:
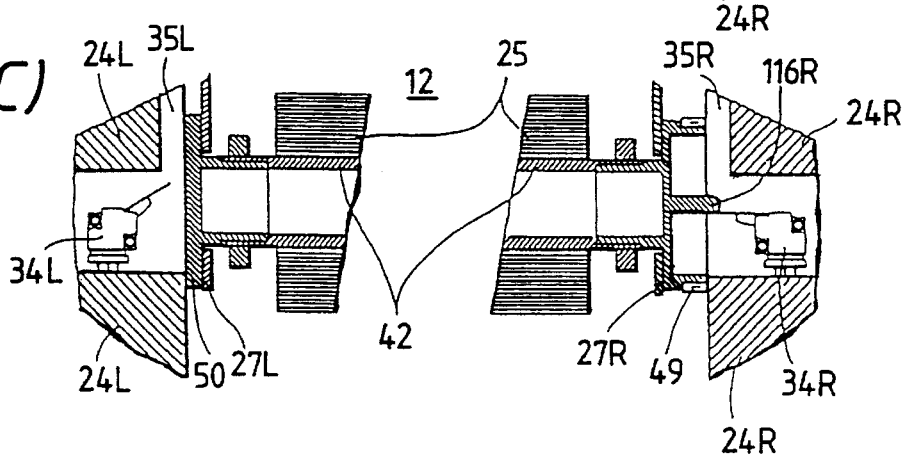

Next, one embodiment of transfer sheet discriminating means will be explained with reference to FIGS. 16(A) to 16(C). FIG. 16(A) corresponds to a type 1 transfer sheet, FIG. 16(B) corresponds to a type 2 transfer sheet, and FIG. 16(C) corresponds to a type 3 transfer sheet. As clearly shown in FIGS. 16(A) to 16(C), existence of each of these pins 116R, 116L is differentiated depending on the type of the transfer sheet. The difference of provision of pins is directly reflected on ON-OFF pattern of two detecting switches 34R, 34L, which is judged by a micro computer. The following table 1 shows relations of ON-OFF patterns of the switches 34R, 34L and types of the transfer sheet 11.

TABLE 1

| | TYPE 1 | TYPE 2 | TYPE 3 | NON-LOADING |
|---|---|---|---|---|
| SW 34R | ON | OFF | ON | OFF |
| SW 34L | ON | ON | OFF | OFF |

Namely, this transfer sheet discriminating means has capability of detecting up to three kinds of transfer sheets. The kind of the transfer sheet is not limited to a specific aspect. In this respect, difference of ink, recording sheet size, color, color sequence, light and shade will fall into the category of kind of the transfer sheet. When the cartridge 12 or the supply roll 25 is not loaded, none of the detecting switches are actuated. It will facilitate the detection of such a non-loaded condition.

The transfer sheet discriminating means of the present invention is not limited to the above-described one and can be modified variously. For example, this discriminating means can be provided on the wind core 43 instead of the supply core 42. The combination of pins and detecting switches can be replaced by a combination of recesses and distance detecting sensors or a combination of marks and mark detectors.

Throughout FIGS. 14, 15, 17 and 18, a reference numeral 95 represents a shaft, a reference numeral 97 represents an idler gear, a reference numeral 98 represents a gear, a reference numeral 99 represents a gear, a reference numeral 60 represents a looseness-eliminating gear, a reference numeral 61 represents a wind gear, a reference numeral 62 represents a motor, a reference numeral 63 represents a motor gear, a reference numeral 64 represents a gear, a reference numeral 65 represents a gear, a reference numeral 66 represents a gear, a reference numeral 67 represents a gear, a reference numeral 68 represents a torque limiter, a reference numeral 105 represents a gear, a reference numeral 106 represents a gear, a reference numeral 107 represents an idler gear, a reference numeral 108 represents an axis, a reference numeral 109 represents an axis, a reference numeral 110 represents a switching arm, a reference numeral 101 represents a fixing plate, a reference numeral 125 represents an output shaft, a reference numeral 126 represents an axis, a reference numeral 127 represents an axis, a reference numeral 128 represents an axis, a reference numeral 129 represents a shaft, a reference numeral 133 represents a cam plate, a reference numeral 134 represents a pin, a reference numeral 135 represents an elongated hole, a reference numeral 138 represents a plate member, a reference numeral 139 represents an axis, a reference numeral 140 represents a link, a reference numeral 141 represents an axis, a reference numeral 142 represents an elongated hole, a reference numeral 145 represents a guide hole, a reference numeral 146 represents a stopper, and a reference numeral 147 represents a stopper.

Next, a transfer sheet wind/rewind mechanism will be explained with reference to FIGS. 14 and 15.

The fixing plate 101 is disposed at a predetermined position on the outer surface of the frame 17R. The motor 62 is secured on this fixing plate 101. The motor gear 63 is secured to the output shaft 125 of the motor 62. The motor gear 63 is meshed with the gear 64 rotatably supported on the axis 126 protruding from the fixing plate 101. The gear 65 integrally formed with the gear 64 is meshed with the gear 66 rotatably supported on the axis 127 protruding from the fixing plate 101. The gear 67 integrally formed with the gear 66 is meshed with the gear 97 rotatably supported on the axis 128 protruding from the fixing plate 101. The gear 97 is meshed with the gear 98 secured to the torque limiter 68. Through the torque limiter 68, a right frame 17R side of the shaft 129 is secured to the wind gear 61 which is coaxial with the gear 98. The wind gear 61 is meshed with the wind roll gear **56*a* installed on the cartridge 12**.

Meanwhile, the motor gear 63 is meshed with the gear 105 rotatably supported on the axis 109 protruding from the fixing plate 101. The gear 106 integrally formed with the gear 105 is meshed with the idler gear 107 rotatably supported on the axis 108 protruding from the bent portion of the switching arm 110. One end of the switching arm 110 is connected to the axis 109, so as to allow rotation. When the switching arm 110 causes a predetermined rotational motion so as to retract the thermal head mechanism section 10, when the thermal head mechanism section 10 is positioned at a setting position, the idler gear 107 is meshed with the gear 99. Otherwise, the idler gear 107 is disengaged from the gear 99. The shaft 95 fixing the gear 99 is rotatably supporting on the right frame 17R. The looseness-eliminating gear 60 is fixed on the inner surface of the right frame 17R so as to oppose to the shaft 95. The looseness-eliminating gear 60 is meshed with the supply roll gear **56*b* installed on the cartridge 12**.

The other end of the switching arm 110 has the elongated hole 135, into which the pin 134 is loosely coupled. One end of the pin 134 is secured to the cam plate 133. The other end of the cam plate 133 rotatably supports the shaft 22. The shaft 22 has right and left end portions rotatably supported by right and left frames 17R, 17L. Accordingly, a rotational motion of the shaft 22 is converted into a swing motion of the switching arm 110 about the axis 109, thereby engaging or disengaging the idler gear 107 with or from the gear 99. The shaft 22 is fixedly connected with the fixing claws 20R, 20L as shown in FIG. 5.

Next, a mechanism enabling the shaft 22 to cause a rotational motion will be explained with reference to FIGS. 17 and 18.

The head retracting lever 136 is fixed to the shaft 22 outside the left frame 17L. The head retracting lever 136 is given a torque by a spring (not shown). This torque acts about the shaft 22 in the counterclockwise direction in FIG. 17; therefore, the head retracting lever 136 is held at a position where a stopper 247 contacts with the head retracting lever 136. An elongated hole 142 is provided at one end of the head retracting lever 136. The axis 141 is slidably and swingably engaged with this elongated hole 142. The link 140 has one end fixed to one end of this axis 141. The axis 139 is rotatably held on the other end of the link 140. The axis 139 is fixed to a predetermined position on the plate member 138. The plate member 138 is fixed to a left-hand plate 86L of the thermal head mechanism section 10.

A head lock lever 137 is rotatably held on the shaft 22 outside the head retracting lever 136. The head lock lever 137 has one end abutting the axis 141.

Next, a retracting motion of the thermal head mechanism section 10 will be explained with reference to FIG. 17. When the head retracting lever 136 and the head lock lever 137 are pinched, the head retracting lever 136 moves in a clockwise direction against a spring (not shown) and the axis 141 moves slightly upward along the elongated hole 142 in the drawing. The thermal head mechanism section 10 connected through the link 140 to the axis 141 moves slightly in the clockwise direction in response to the movement of the head retracting lever 136. As a result, the fixing pins 21R, 21L (FIG. 4) secured to the thermal head mechanism section 10 are spaced from the fixing claws 20R, 20L (FIGS. 4, 5 and 6) secured to the shaft 22. In addition, a rotation of the shaft 22 generated in response to the rotation of the head retracting lever 136 causes rotations of the fixing claws 20R, 20L, thereby disengaging the fixing claws 20R, 20L from the fixing pins 21R, 21L, respectively.

Figure 17:
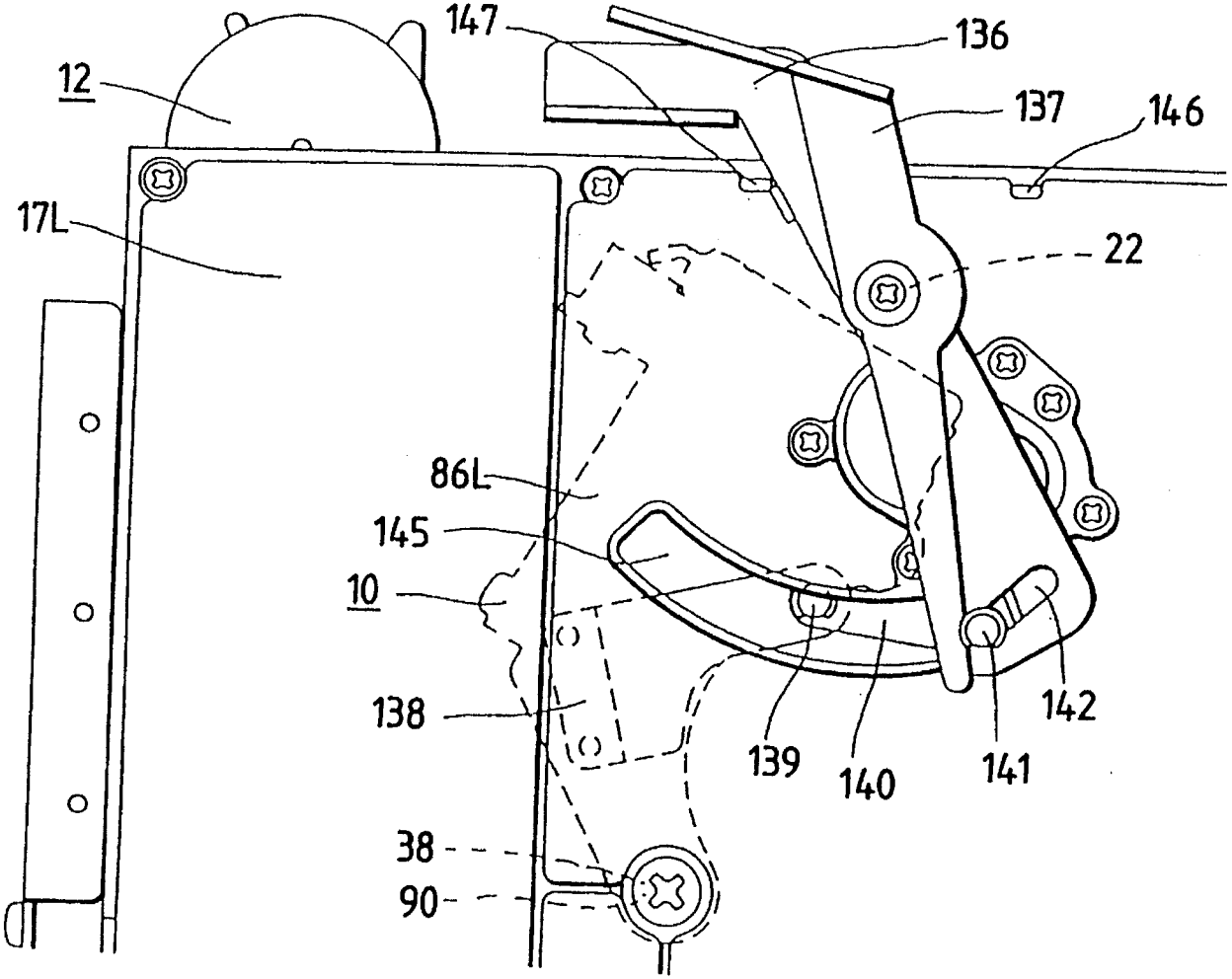
FIG. 17 is a left side view showing a setting condition of the thermal head mechanism section.
Figure 18:
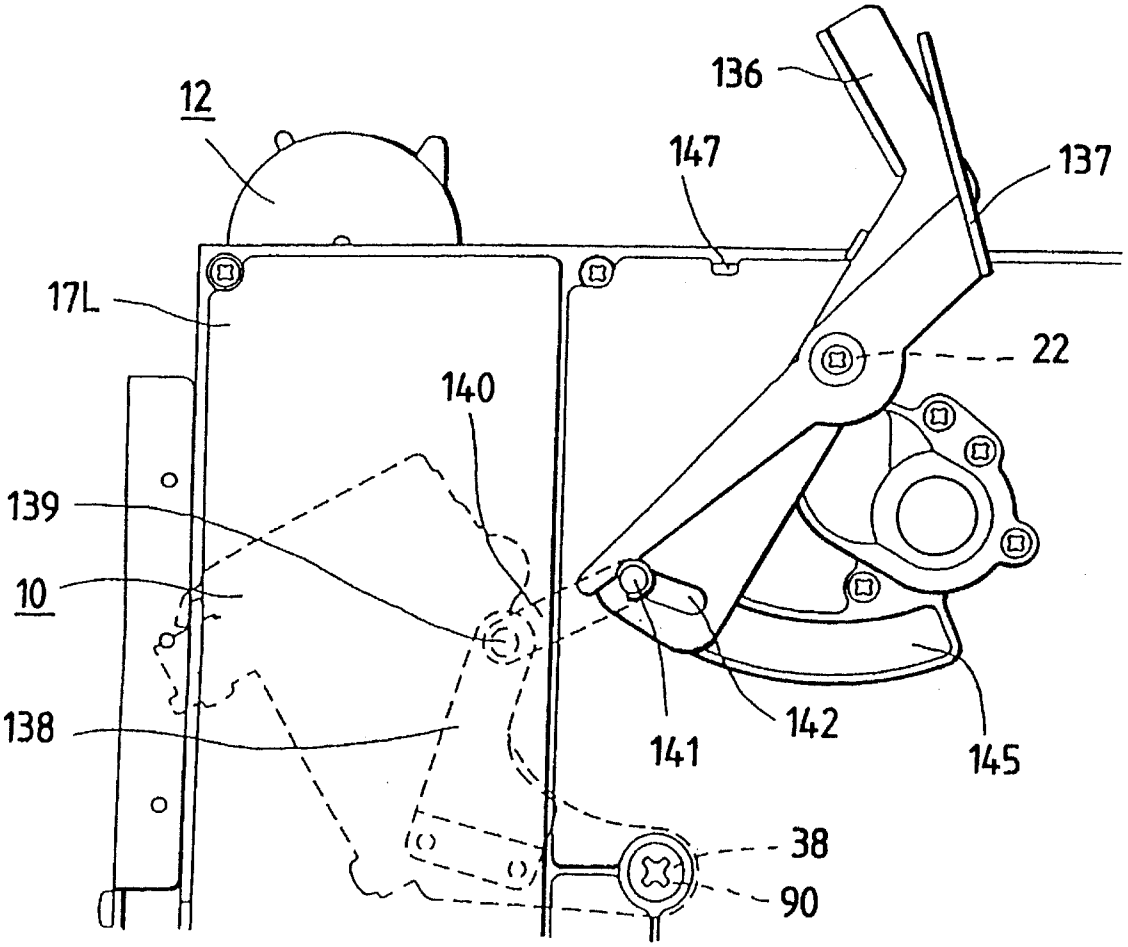
FIG. 18 is a left side view showing a retracted condition of the thermal head mechanism section.

In FIG. 17, if the head retracting lever 136 and the head lock lever 137 pinched together are further rotated in the clockwise direction until they reach the stopper 146, the thermal head mechanism section 10 then rotates in the counterclockwise direction being guided by the link 140 and retained at a predetermined position.

The shaft 22, rotating in response to the rotation of the head retracting lever 136, causes the switching arm 110 disposed outside the right frame 17R to rotate in the counterclockwise direction in FIG. 15 and engages the idler gear 107 with the gear 99. (FIGS. 14 and 15)

A setting operation of the thermal head mechanism section 10 is carried out oppositely. More specifically, in FIG. 18, the head retracting lever 136 and the head lock lever 137 are pinched and rotated in the counterclockwise direction until they reach the stopper 147. Then, upon releasing the head retracting lever 136 and the head lock lever 137, the fixing claws 20R, 20L are engaged with the fixing pins 21R, 21L so as to locate the thermal head mechanism section 10 at a predetermined setting position.

The shaft 22, rotating in response to the rotation of the head retracting lever 136, causes the switching arm 110 disposed outside the right frame 17R to rotate in the clockwise direction in FIG. 15 and disengages the idler gear 107 from the gear 99. (FIGS. 14 and 15)

Next, an operation for eliminating looseness of the transfer sheet 11 will be explained with reference to FIG. 15. Looseness of the transfer sheet 11 is normally found when the cartridge 12 is newly loaded in the printer 1 or when the thermal head mechanism section 10 is moved from the setting position to the retracted position. In any event, looseness of the transfer sheet 11 occurs in the condition where the thermal head mechanism section 10 is retracted backward. In other words, the idler gear 107 is engaged with the gear 99 when the transfer sheet 11 is loosened.

When the motor 62 rotates in the counterclockwise direction in FIG. 15, the motor gear 63 securely fixed on the output shaft 125 of the motor 62 makes the gear 64 rotate in the clockwise direction. The gear 65 integrated with the gear 64 reduces the speed of the gear 66 and makes the gear 66 rotate in the counterclockwise direction. The gear 67 integrated with the gear 66 reduces the speed of the gear 97 and makes the gear 97 rotate in the clockwise direction. The gear 98 meshing with the gear 97 rotates in the counterclockwise direction. A rotation of the gear 98 is transmitted through the torque limiter 68 and the shaft 129 to the wind gear 61. Thus the geared flange 49, meshing with the wind gear 61, rotates at a reduce speed in the clockwise direction. The wind roll 26 connected with the geared flange 49 rotates in the clockwise direction; namely, the transfer sheet is wound.

On the contrary, when the motor 62 rotates in the clockwise direction in FIG. 15, the gear 63 securely fixed on the output shaft 125 of the motor 62 makes the gear 105 rotate in the counterclockwise direction. The gear 106 integrated with the gear 105 reduces the speed of the idler gear 107 and makes the idler gear 107 rotate in the clockwise direction. As the idler gear 107 is meshed with the gear 99, the gear 99 rotates the looseness-eliminating gear 60 in the counterclockwise direction. As the looseness-eliminating gear 60 is meshed with the geared flange 49, the supply roll 25 connected to the geared flange 49 rotates in the clockwise direction; namely, the transfer sheet 11 is wound.

Accordingly, in this case, the wind roll 26 rotates in a direction to send out the transfer sheet 11, looseness of the transfer sheet 11 can be completely removed due to difference of gear reduction ratio, which makes a winding amount of the supply roll 25 be larger than a sending-out amount of the wind roll 26. If the load acting on the transfer sheet 11 exceeds a predetermined value, the torque limiter 68 causes slip so as to maintain an adequate tension.

Figure 19:
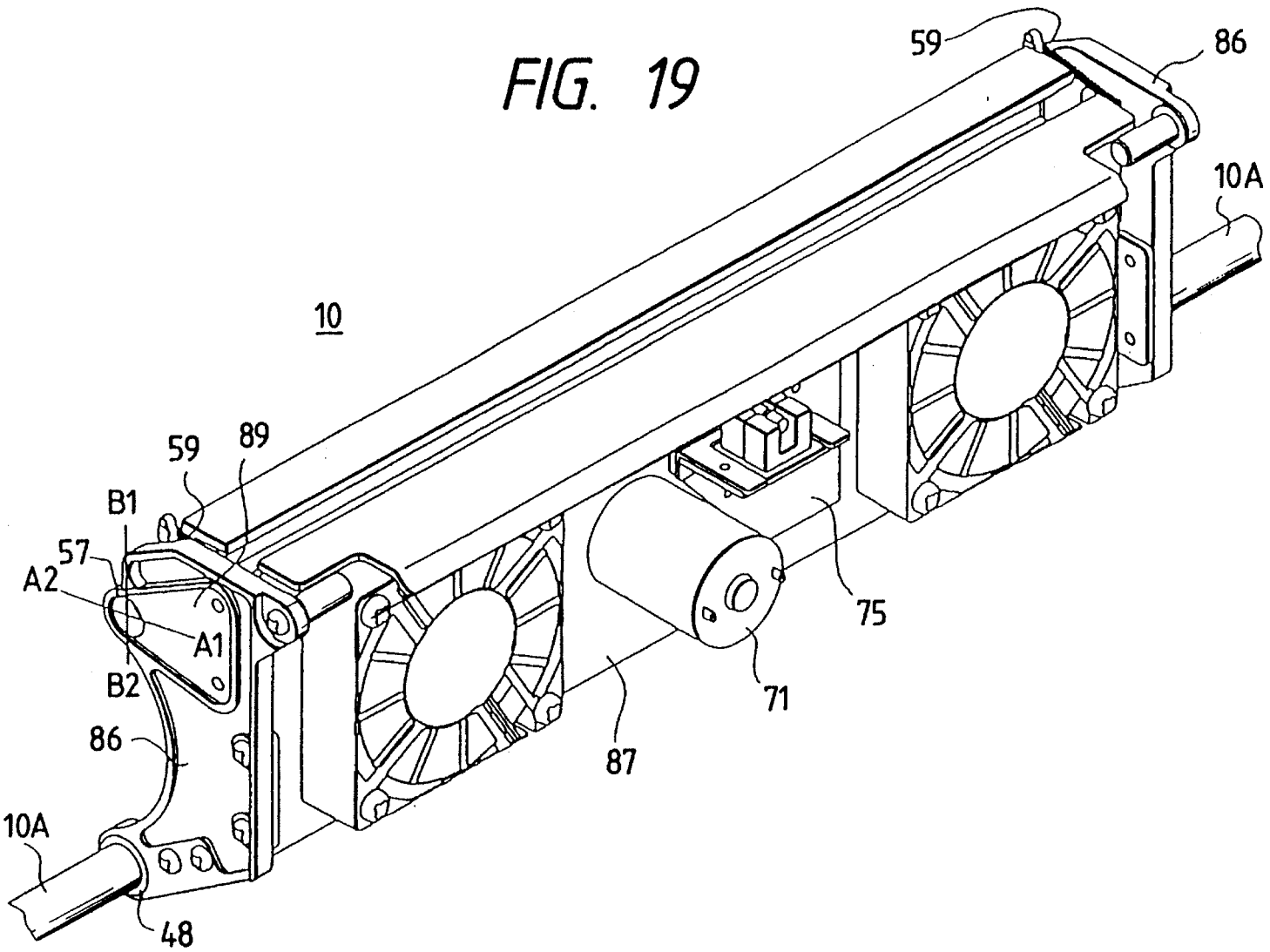
FIG. 19 is a perspective view showing a rear surface of the thermal head mechanism section.

Next, the thermal head mechanism section 10 will be explained with reference to FIGS. 19 to 23. FIG. 19 is a perspective view showing a rear side of the thermal head mechanism section 10. As illustrated in FIG. 19, frame arrangement of the thermal head mechanism section 10 comprises right and left aluminum die-casting side plates 86, 86, and a stay 87 connecting these right and left side plates 86, 86. Each of these side plates 86, 86 is supported by a shaft 10A through a metal bearing (not shown) so as to be rotatable in the printer 1. The shaft 10A extends from each of the frames 17R and 17L.

Figure 20:
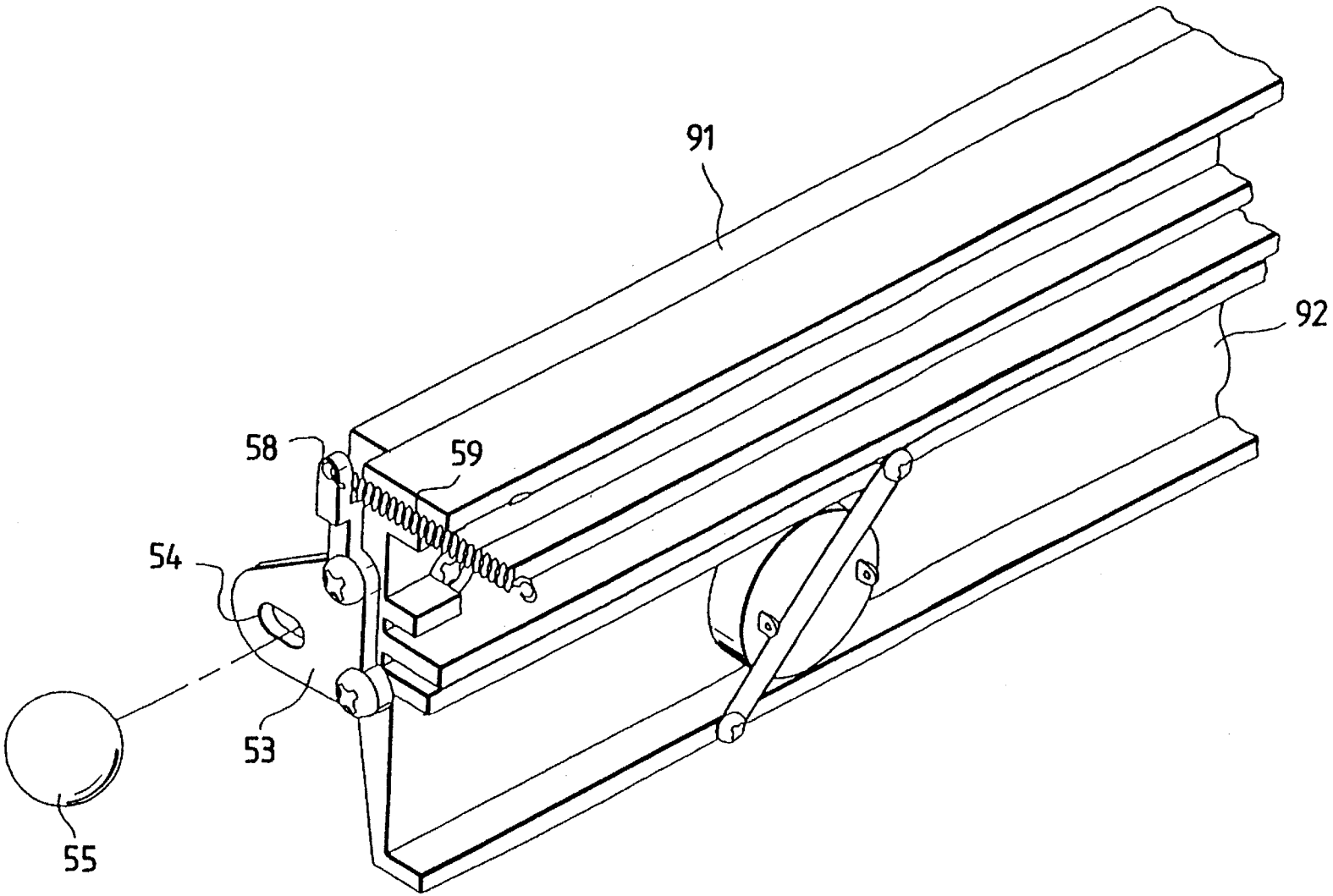
FIG. 20 is an exploded perspective view showing the thermal head mechanism section.

As illustrated in FIG. 20, the thermal head 91 has a reverse surface fixed through a paste or the like having better heat conductivity to a heat sink 92 made of an aluminum extrusion material. Both ends of the heat sink 92 are fixed to the plate members 53, 53. The plate member 53 has an elongated hole 54 extending parallel to a pressing direction of the thermal head 91. This elongated hole 54 is cooperative with a holding hole 57 opened on a triangle flat spring 89 provided along the side plate 86 to retain a steel ball 55 therebetween. With this steel ball 55 as a rotational center, the heat sink 92 assembled with the thermal head 91 is rotatably supported with respect to the platen roller 7.

A spring 59, connecting a spring hook 58 of the plate member 53 and a spring hook (not shown) of the stay 87, biases the thermal head 91 so as to keep it away from the platen roller 7.

Figure 21A:
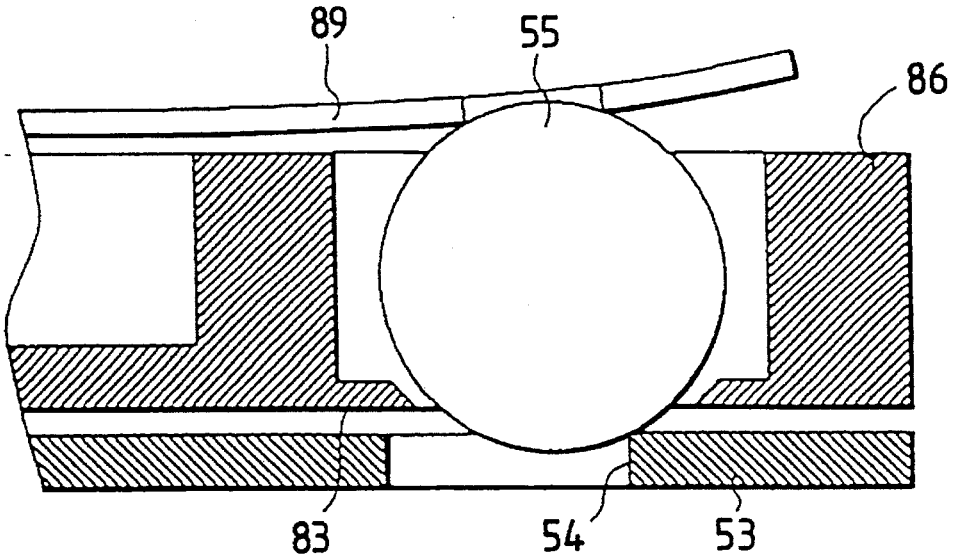
FIG. 21(A) is a cross-sectional view taken along a line A1–A2 of FIG. 19.
Figure 21B:
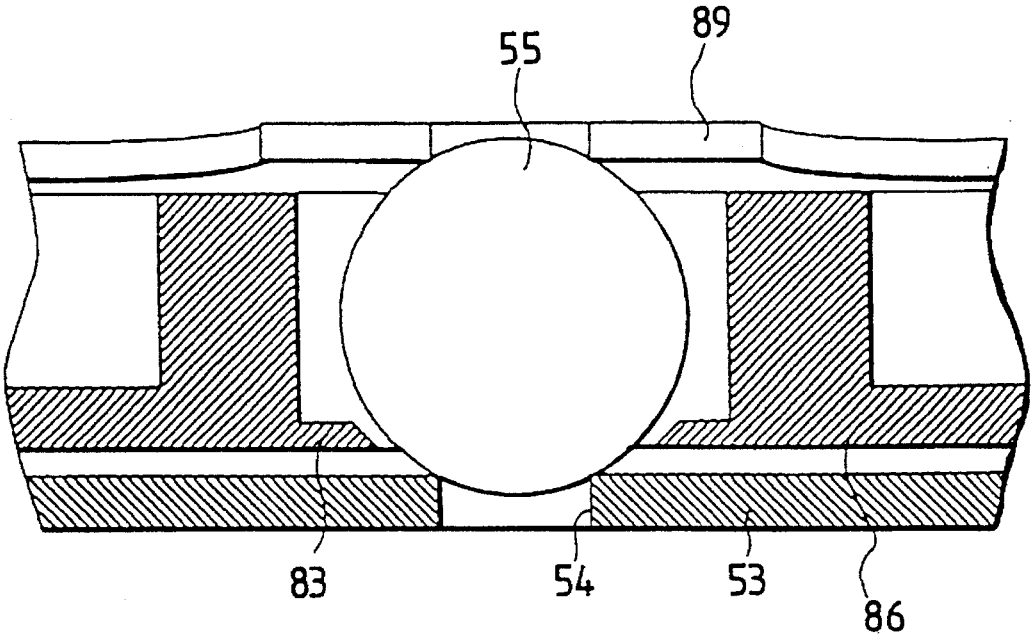
FIG. 21(B) is a cross-sectional view taken along a line B1–B2 of FIG. 19.

The steel ball 55 is held in a recess of the side plate 86, as shown in FIGS. 21(A) and 21(B). FIGS. 21(A) and 21(B) are cross-sectional views showing structure for supporting the heat sink 92 in the thermal head mechanism section 10. FIG. 21(A) is a lateral cross-sectional view taken along a line A1–A2 of FIG. 19 which is parallel to the longitudinal direction of the elongated hole 54, while FIG. 21(B) is a vertical cross-sectional view taken along a line B1–B2 of FIG. 19, which is perpendicular to the line A1–A2. These FIGS. 21(A) and 21(B) show a condition where the steel ball 55 is received by a stopper 83 provided on the side plate 86 and biased by the flat spring 89.

As shown in FIG. 21(B), the steel ball 55 is held at two points on the confronting sides of the elongated hole 54. Therefore, the steel ball 55 can only roll in the longitudinal direction of the elongated hole 54. It means that the thermal head 91 does not fluctuate in its vertical direction (i.e. a transportation direction of the recording sheet 2). Furthermore, as the steel ball 55 is urged inward by the flat spring 89, the thermal head 91 does not cause fluctuation in its lateral direction (i.e. a width direction of the recording sheet 2).

Moreover, as both ends of the heat sink 92 are rotatably supported through the steel balls 55, 55 received in the elongated holes 54, 54, swing motion of the thermal head 91 is very smooth and a pressing force applied from the thermal head 91 to the platen roller 7 can be equalized between right and left ends of the platen roller 7. Still further, by sliding the heat sink 92 against the biasing force of the flat spring 89, the heat sink 92 assembled with the thermal head 91 can be easily detached from the thermal head mechanism section 10.

Figure 22:
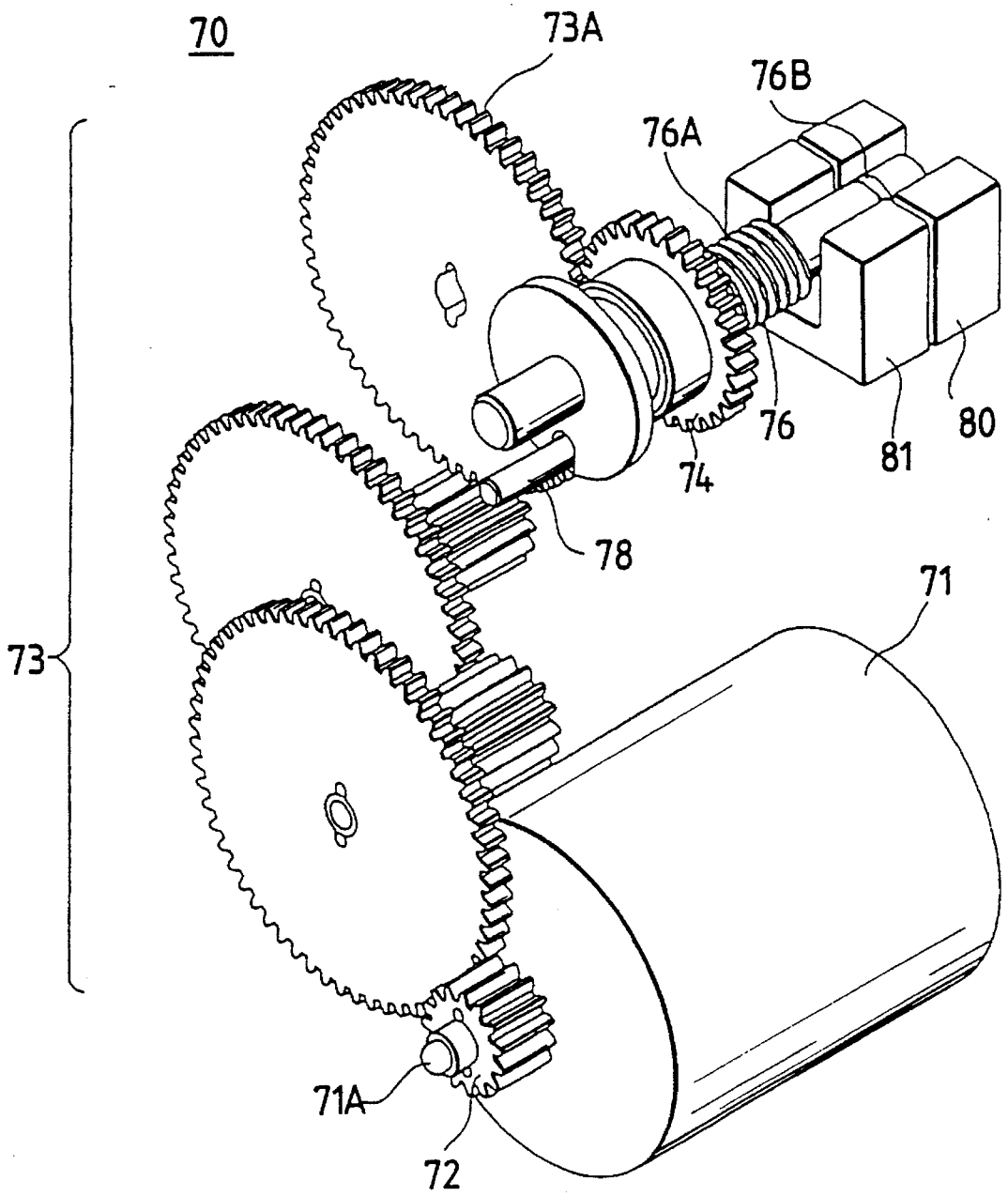
FIG. 22 is a perspective view showing a thermal head pressing mechanism.

Next, a thermal head pressing mechanism 70, pressing the thermal head 91 against the platen roller 7, will be explained with reference to FIGS. 19, 22 and 23. In FIG. 22, the thermal head pressing mechanism 70 comprises a motor 71 serving as a driving source for pressing the thermal head 91 against the platen roller 7 or releasing it away from the platen roller 7, a gear 72 securely fixed on a rotational shaft 71A of the motor 71, a gear train 73 transmitting a rotation of the gear 72 to a gear 74 at a reduced speed, a pressing shaft 76 pressing the thermal head 91 inserted into a central hole 74A (refer to FIG. 23(A)) of the gear 74 against the platen roller 7, a pin 78 provided on the stay 87 for preventing the pressing shaft 76 from being rotated together with the gear 74, and transmission-type photo sensors 80, 81 for detecting the position of the pressing shaft 76.

The motor 71 is, as shown in FIG. 19, fixed to the rear surface of the stay 87 of the thermal head mechanism section 10. The gear train 73 is installed on the stay 87 or the plate member 75 disposed on the stay 87. The gear 74 is, as shown in FIG. 23 (A), rotatably fixed between the stay 87 and the plate member 75 in the thermal head mechanism section 10.

Furthermore, as shown in FIG. 22, the central hole 74A into which the pressing shaft 76 of the gear 74 is inserted has an inner circumferential surface with female screw configuration, while the pressing shaft 76 has an outer circumferential surface with male screw configuration 76A partly so as to be threaded into the central hole 74A.

In this thermal head pressing mechanism 70, when the motor 71 rotates, rotational output of the motor 71 is transmitted to the gear train 73 through the gear 72, and further to the gear 74 provided next to the idler gear 73A of the gear train 73. A rotation of the gear 74 moves the pressing shaft 76 in the pressing direction of the thermal head 91. When moved toward the thermal head 91, the pressing shaft 76 presses the rear surface of the heat sink 92 assembled with the thermal head 91. With this press operation, the thermal head 91 is pressed against the platen roller 7. The pressing shaft 76 is provided at a position corresponding to the lateral center of the thermal head 91.

Figure 23A:
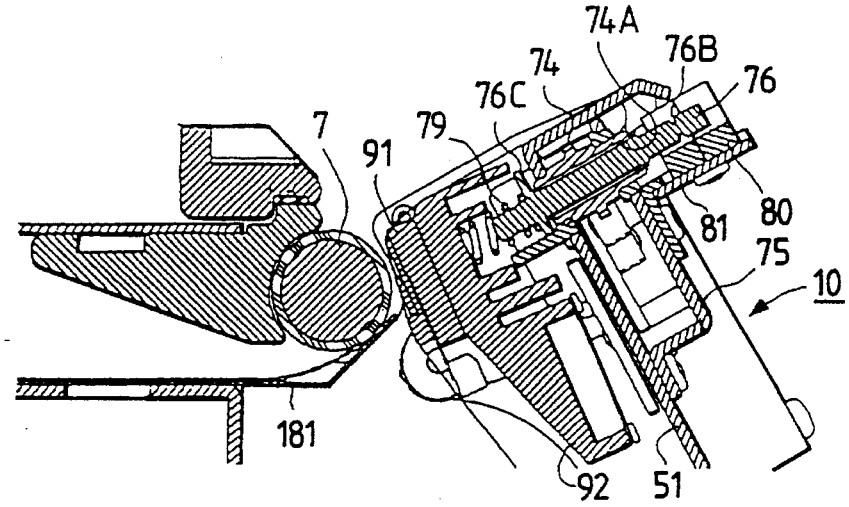
FIG. 23(A) is a cross-sectional view showing a condition where the thermal head is completely spaced from the platen roller.

As illustrated in FIG. 23(A), there is provided a compression spring 79 between a spring stopper 76C and the heat sink 92. When the pressing shaft 76 shifts left in the drawing, the compression spring 79 rotates the thermal head 91 toward the platen roller 7. After the thermal head 91 is brought into contact with the platen roller 7, if the pressing shaft 76 is further shifted left, the compression spring 79 is compressed, thereby converting elastic force of the compression spring 79 to pressing force of the thermal head 91.

As the thermal head 91, supported swingable in the horizontal direction as described above, presses the lateral center of the thermal head 91, the pressing force of this thermal head 91 is evenly applied to both ends of the thermal head 91.

Such a construction of the thermal head pressing mechanism 70 is advantageous in reducing size of the pressing mechanism 70. Namely, the feeding screw construction based on the combination of female screw configuration of the gear 74 and male screw configuration 76A of the pressing shaft 76 qualifies as a speed reduction mechanism does not cause pressing force loss derived from deformation of parts, allows the motor 71 to be small, and does not require a large part such as a cam. This compact construction, therefore, enables the thermal head pressing mechanism 70 to be installed on the rear surface of the thermal head mechanism section 10, thereby realizing size reduction of the printer 1.

Control for pressing or releasing the thermal head 91 against or from the platen roller 7 is executed based on signals of the transmission type photo sensors 80, 81 which detect the position of the pressing shaft 76. Hereinafter, this pressing/releasing control will be explained in detail with reference to FIGS. 23(A) to 23(C).

FIG. 23(A) shows a condition where the thermal head 91 is completely spaced from the platen roller 7. The thermal head 91 takes this position all the time except recording operation and sheet feeding operation of the recording sheet 2. When the thermal head 91 is released in this manner, the pressing shaft 76 intercepts both beams of the photo sensors 80, 81. Accordingly, a released position of the thermal head 91 can be known from the fact that both the photo sensors 80, 81 generate OFF signals.

Figure 23B:
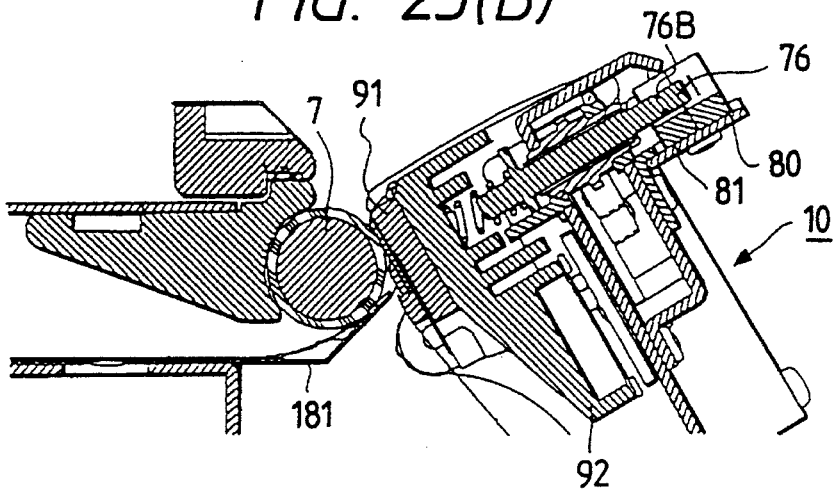
FIG. 23(B) is a cross-sectional view showing a condition where the thermal head is brought into contact with the platen roller.

FIG. 23(B) shows a condition where the thermal head 91 is brought into contact with the platen roller 7. The thermal head 91 takes this position, for example, when the recording sheet 2 is fed; namely, contact of the thermal head 91 to the platen roller 7 causes a frictional force required for feeding the recording sheet 2 with respect to the platen roller 7. When the thermal head 91 is brought into contact with the platen roller 7 in this manner, the pressing shaft 76 is shifted left to a position where a beam of the photo sensor 80 is completely transmitted without interception by the pressing shaft 76. Meanwhile, a beam of the photo sensor 81 is partly transmitted through a neck portion 76B of the pressing shaft 76. Consequently, if the signals of the photo sensors 80, 81 are both turned from OFF to ON, it means that the thermal head 91 is in a contact position.

Figure 23C:
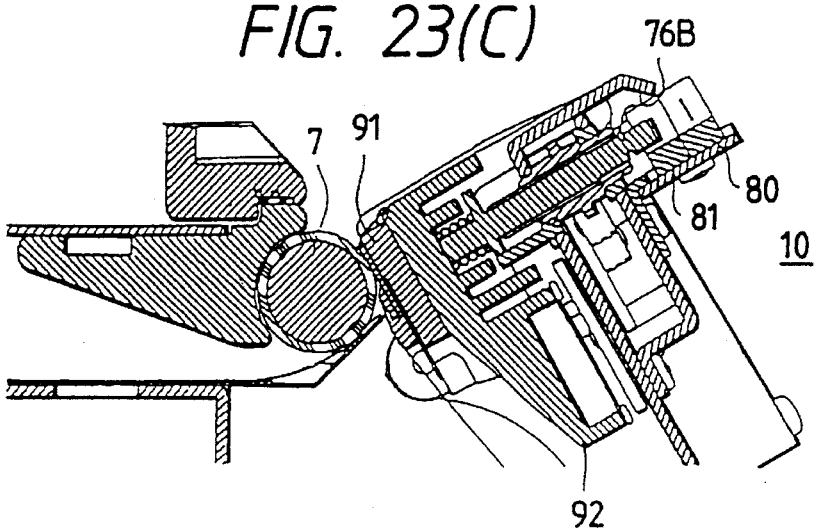
FIG. 23(C) is a cross-sectional view showing a condition where the thermal head is pressed against the platen roller.

Furthermore, FIG. 23(C) shows a condition where the thermal head 91 is pressed against the platen roller 7. The thermal head 91 takes this position in the recording operation. As described above, the compression spring 79 generates a force pressing the thermal head 91 against the platen roller 7. When the thermal head 91 is pressed against the platen roller 7 in this manner, the pressing shaft 76 is further shifted left. Thus, the beam of photo sensor 81 is temporarily intercepted by the pressing shaft 76 but is thereafter completely transmitted. That is, the photo sensor 80 keeps ON condition, while the signal of photo sensor 81 is changed from ON to OFF and then again to ON. Such signal changes indicate that the thermal head 91 is in a pressed position.

In this manner, by directly detecting the position of the pressing shaft 76, it becomes possible to detect the position of the thermal head 91 accurately. Furthermore, by providing the neck portion 76B, two photo detectors 80, 81 can detect up to three positions (i.e. released position, contact position, and pressed position).

Figure 7:
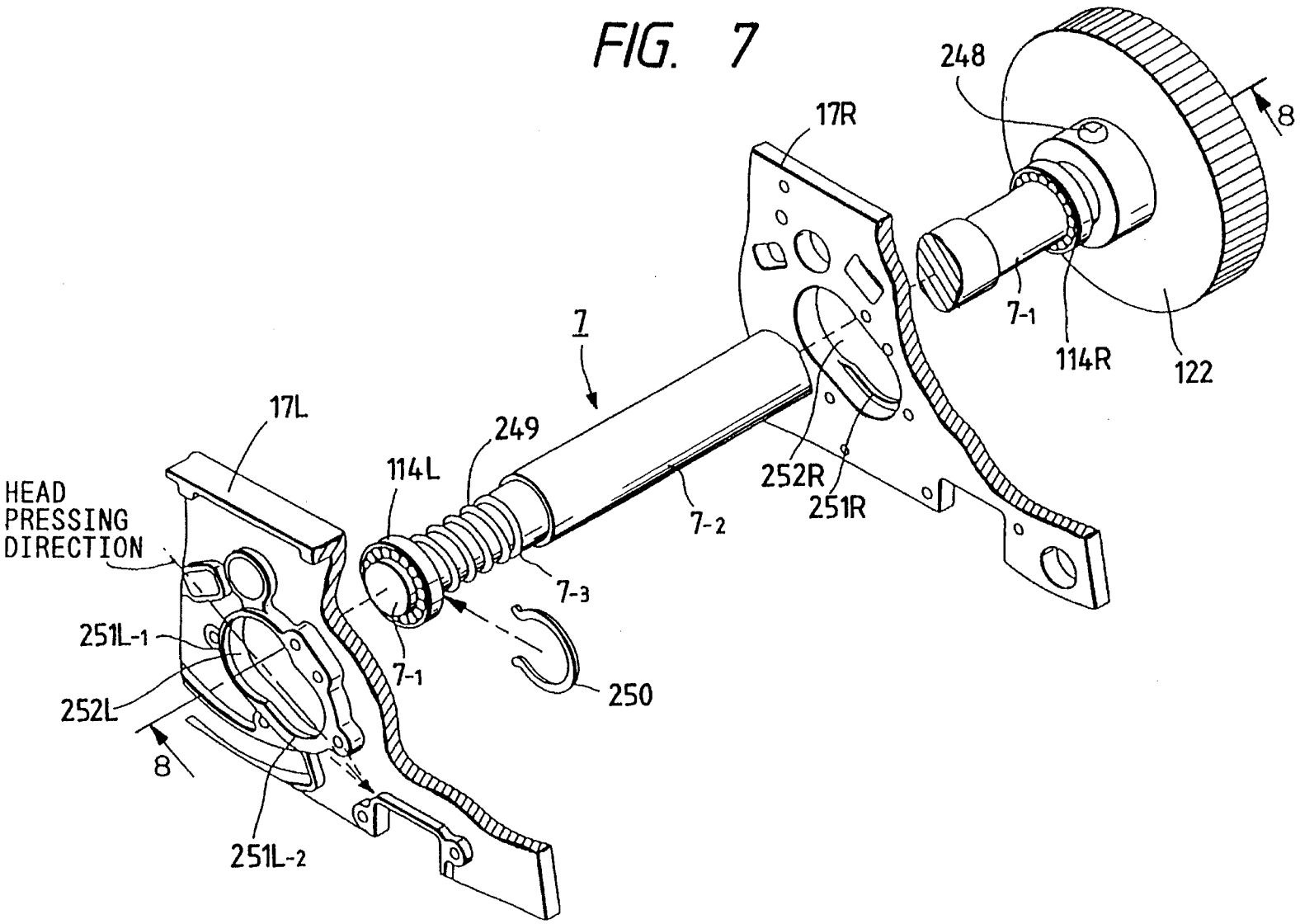
FIG. 7 is a schematic perspective view showing a platen roller and its vicinity.
Figure 8:
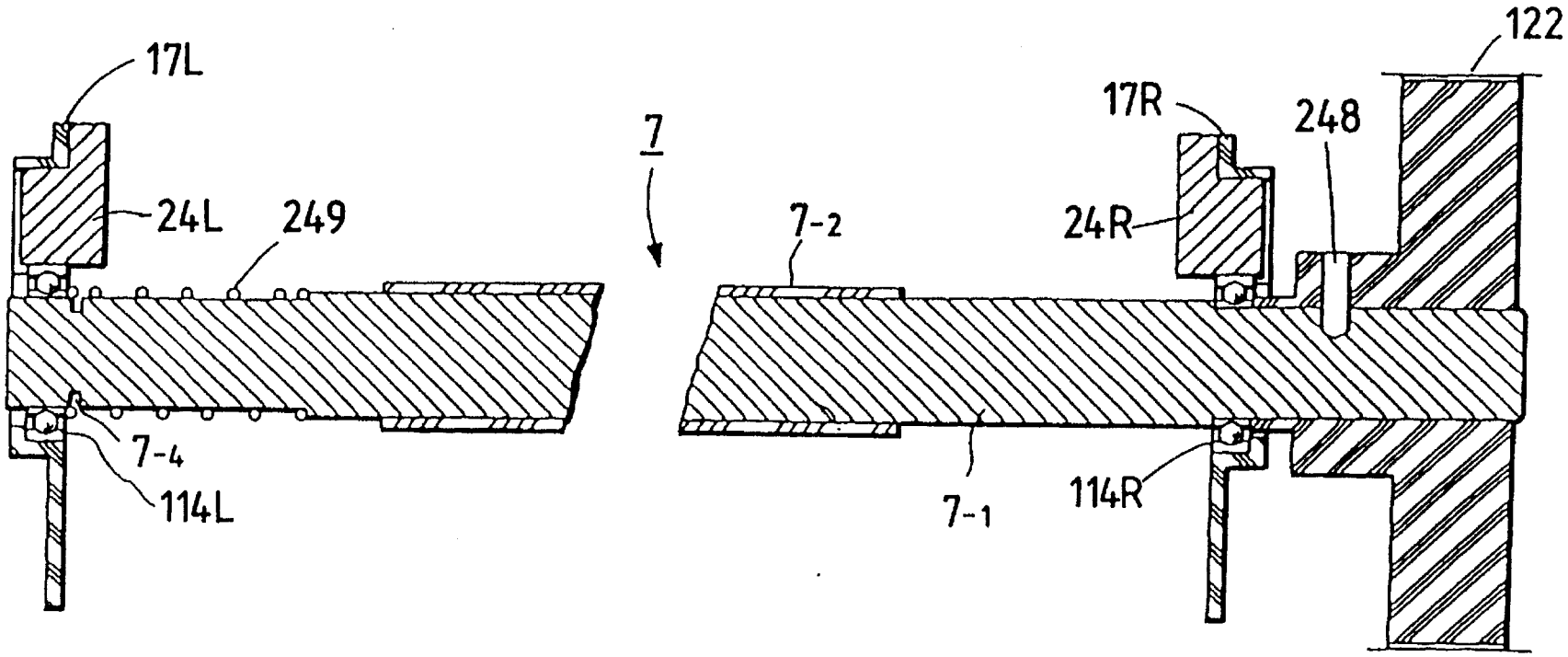
FIG. 8 is a cross-sectional view taken along a line B—B of FIG. 7.

Next, mechanism of the platen roller 7 opposing to the thermal head mechanism section 10 will be explained with reference to FIGS. 7 and 8. FIG. 7 shows a schematic perspective view showing the platen roller 7 and its vicinity. FIG. 8 is a cross-sectional view taken along a line B—B of FIG. 8.

The platen roller 7 is installed between the right and left frames 17R, 17L after being assembled as a sub unit. The platen roller 7 includes a metallic shaft 7-1 wound by an elastic member such as rubber to constitute a roller portion 7-2. At both ends of the roller portion 7-2 there are provided ball bearings 114R, 114L. A pulley 122 is provided outside the ball bearing 114R. A spring 249 with one end stopped by an engaging portion 7-3 is interposed between the other ball bearing 114L and the roller portion 7-2 in such a manner that the spring 249 is always biased in an expanding direction. Assembling of this sub unit is carried out by engaging the ball bearing 114R with one end of the shaft 7-1, fixing the pulley 122 by means of the screw 248, inserting the spring 249 having high elasticity from the other end of the shaft 7-1, coupling a C-shaped ring 250 into a groove 7-4 so as to compress the spring 249 slightly, and fixing the ball bearing 114L outside the C-shaped ring 250.

The right frame 17R, supporting the sub-unitized platen roller 7, has an obliquely extending elliptic or elongated hole 252R which has an upper part allowing the ball bearings 114R, 114L to pass through therein. The longitudinal direction of the hole 252R is identical with the pressing direction of the thermal head mechanism section 10. There is formed a flange portion 251R in the lower part of the hole 252R to support or receive the ball bearing 114R from the outside.

In the same manner, the left frame 17L has an elliptic or elongated hole 252L obliquely extending along the pressing direction of the thermal head mechanism section 10. There is formed a flange portion 251L-1 in the upper part of the hole 252L for supporting or receiving the ball bearing 114L from the outside. And also, in the lower part of the hole 252L, there is formed another flange portion 251L-2 continuous to the flange portion 251L-1 and having an inside space which is narrower than that of the flange portion 251L-1 and slightly larger in diameter than the shaft 7-1. Assembling of such a sub-unitized platen roller 7 to the frames 17R, 17L is carried out in the following manner. First of all, the sub-unitized platen roller 7 is inserted through the hole 252R from the outside, until the ball bearing 114L abuts the flange 251L-1. Thereafter, the sub-unitized platen roller 7 is shifted or lowered in a direction parallel to the head pressing direction, until the bearings 114R, 114L settle in the lower spaces of the holes 252R, 252L, respectively. Subsequently, the C-shaped ring 250 is removed, and the bearings 114R, 114L are supported or received by the flanges 251R, 251L-2 of the frames 17R, 17L.

Figure 24:
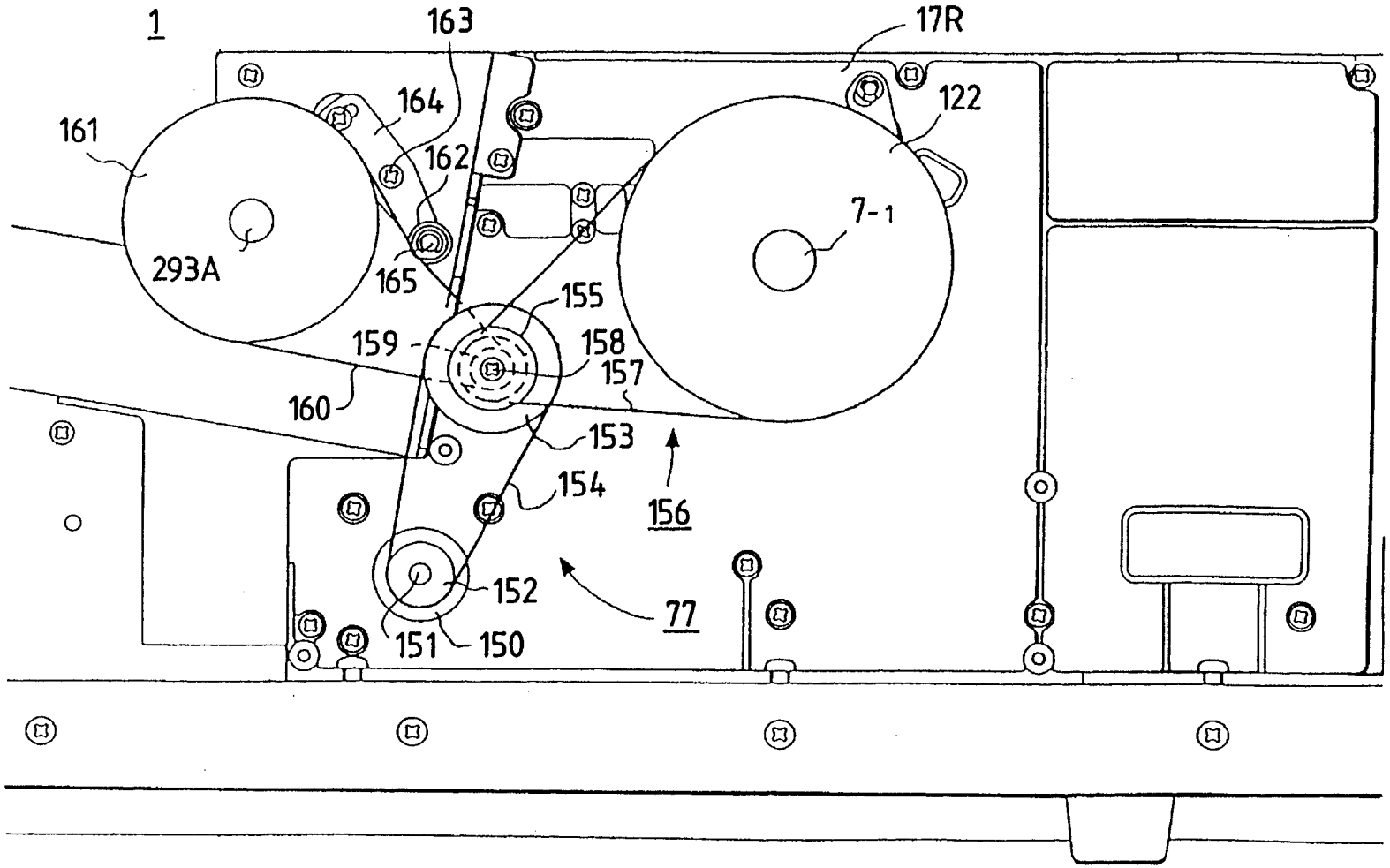
FIG. 24 is a schematic view showing a common drive mechanism for driving the platen roller and a sheet feed/discharge roller.

FIG. 24 shows a driving mechanism for driving the platen roller 7 and a sheet feed/discharge roller 293. In the drawing, the platen roller 7 is driven by the stepping motor 150. The stepping motor 150, fixed on the right frame 17R of the color printer 1, has an output shaft 151. A pulley 152 fixed integrally on the output shaft 151, a pulley 153 rotating about a bearing provided on the right frame 17R, a timing belt 154 entrained between these pulleys 152, 153 cooperatively constitute a speed reduction mechanism 77. Therefore, a rotational output of the stepping motor 150 is transmitted at a reduced speed through this speed reduction mechanism 77. A pulley 155 integral with the pulley 153, a pulley 122 fixed on a metallic shaft 7-1, a timing belt 157 entrained between these pulleys 155, 122 cooperatively constitute another speed reduction mechanism 156. Therefore, a rotational output of the stepping motor 150 is transmitted at a further reduced speed through this speed reduction mechanism 156.

Here, a reduction ratio of the pulley 152 to the pulley 153 is a reciprocal of an integer. Also, a reduction ratio of the pulley 155 to the pulley 122 is a reciprocal of an integer. Accordingly, a finally obtained speed will be reduced to a reciprocal of a certain integer compared with the rotational speed of the stepping motor 150.

Furthermore, a feed amount of the recording sheet 2 is integer lines per rotation of the platen roller 7. The stepping motor 150 causes integer steps per rotation. Therefore, a relationship between a position on the platen roller 7 and a position on the stepping motor 150 is determined in the same manner or univocally with respect to each of colors.

A ratio of the length of the timing belt 154 to the circumferential length of the pulley (small pulley) 152 is an integer. And, a ratio of length of the timing belt 157 to the circumferential length of the pulley (small pulley) 155 is also an integer.

A pulley 159 is provided inside the right frame 17R in opposed relationship with the pulleys 153 and 155 through an axis 158. A timing belt 160 transmits the speed of the pulley 159 to a pulley 161 at a reduced speed. The pulley 161 is integral with an axis 293A of the sheet feed/discharge roller 293. An idler 162 gives a required tension to the timing belt 160. The idler 162 is rotatable about an axis 165 secured on an adjusting plate 164 whose rotational position about its center is adjustable by a screw 163.

Figure 9:
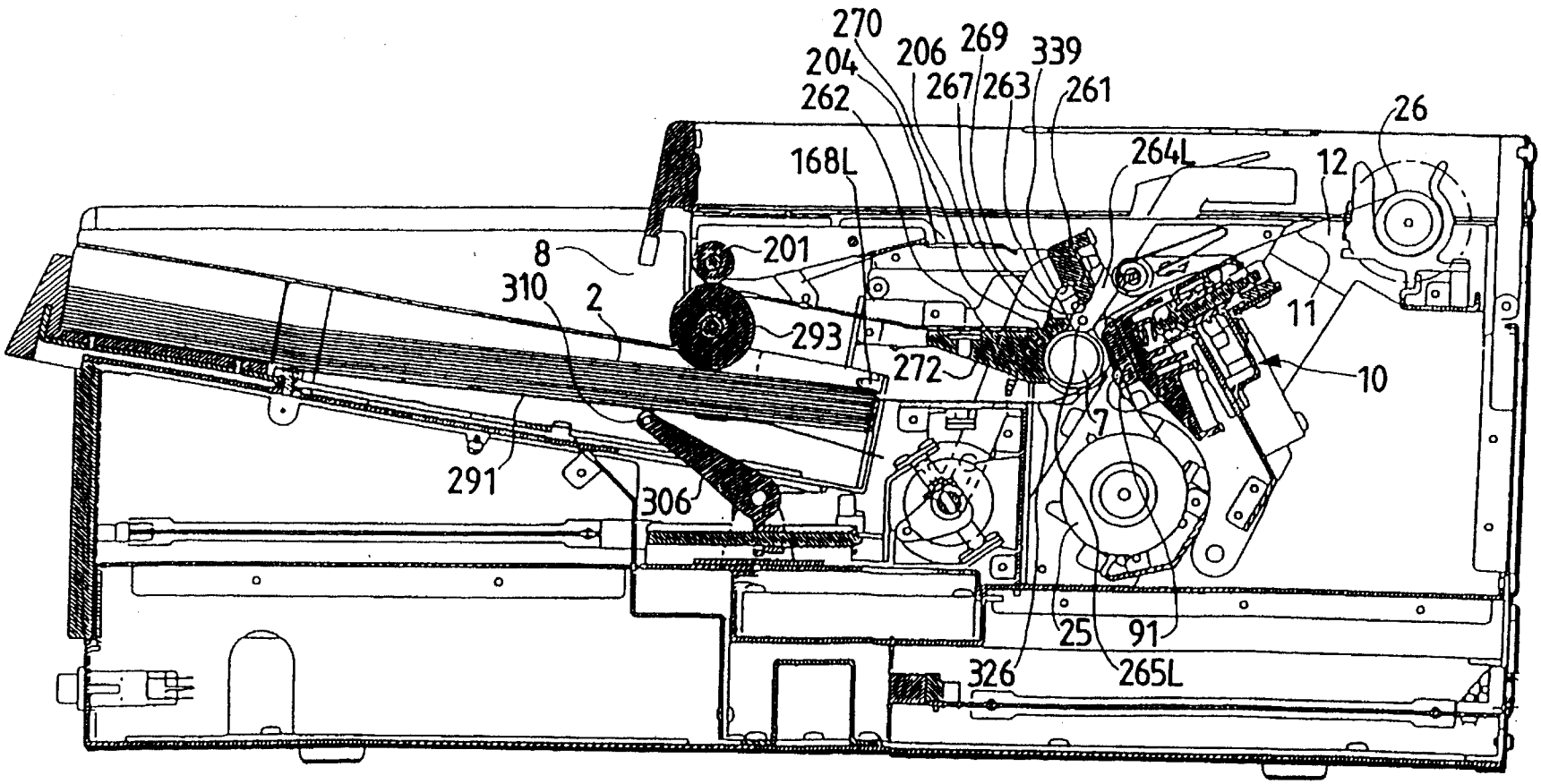
FIG. 9 is a vertical cross-sectional view showing a sheet transportation condition.
Figure 10:
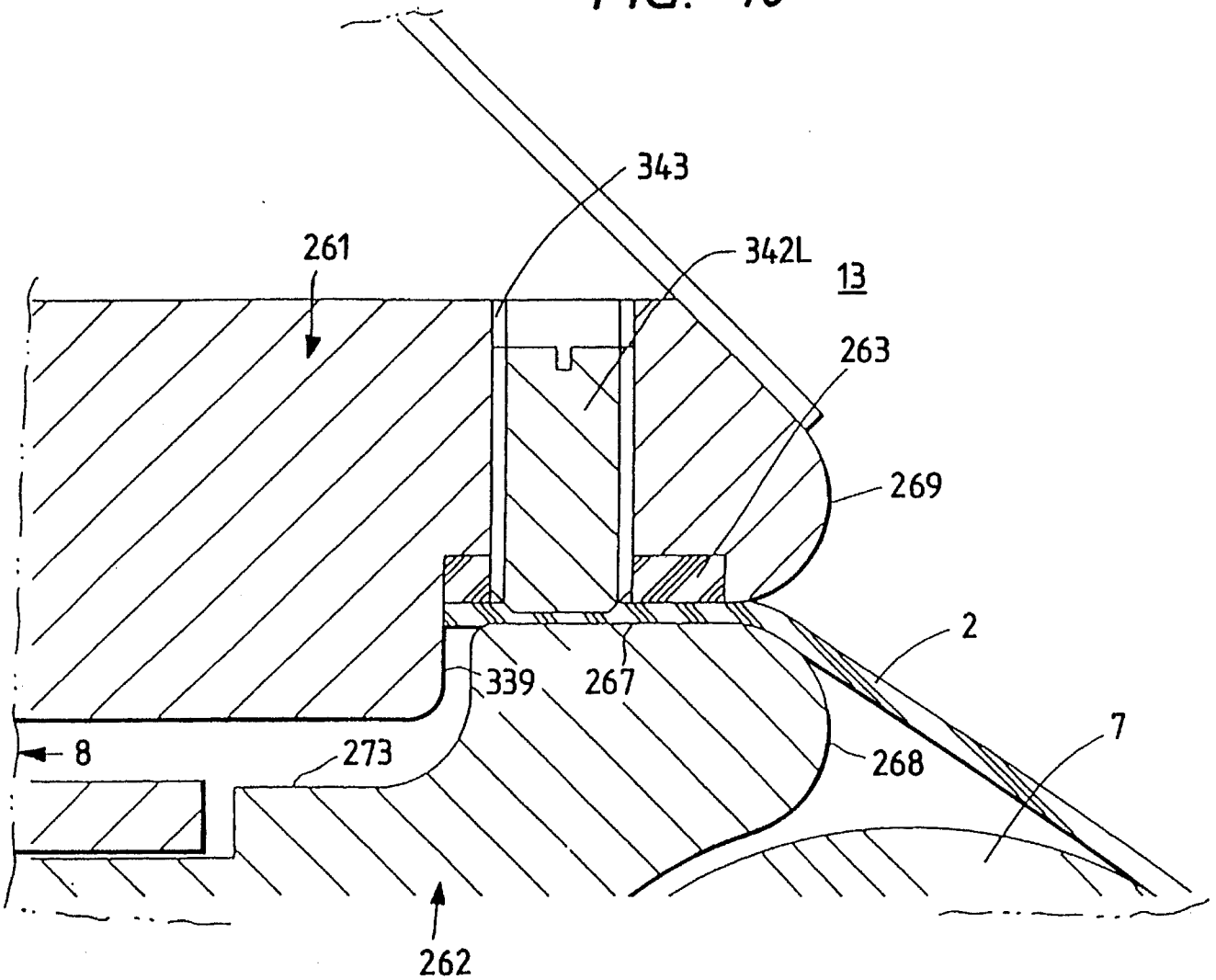
FIG. 10 is an enlarged vertical cross-sectional view showing a clamp mechanism section.

Next, the clamp mechanism 13 will be explained with reference to FIGS. 9 and 10. FIG. 9 shows a condition where the recording sheet 2 is transported. FIG. 10 is an enlarged view partly showing the construction of the clamp mechanism 13. The clamp mechanism 13 is chiefly constituted by a movable clamp member 261 and a stationary clamp member 262. The movable clamp member 261, made of a material having high rigidity, has a cross section of substantially L shape and an evenly flattened surface entirely extending in the widthwise direction. Axes 265R, 265L of the plate members 264R, 264L fixed on the right and left frames 17R, 17L support this movable clamp member 261 pivotally.

A front edge of the movable clamp member 261 is formed with a round surface 269 so as to prevent an incoming or travelling recording sheet 2 from being folded. A clamp surface 263, made of a frictional member such as rubber, is inserted in and bonded to a bottom recess of the movable clamp member 261. A clamp pin 342R or 342L is provided so as to protrude from this clamp surface 263. The clamp pin 342R or 342L is threaded into a screw hole 343, so that a protruding amount of the clamp pin 342R or 342L can be finely adjusted by rotating the clamp pin 342R or 342L itself, thereby providing uniform clamping force. A stepped portion provided inward the clamp surface 283, serves as a stopper portion 339. This stopper portion 339, when the movable clamp member 261 is in an opened position, can stop the recording sheet 2 conveyed obliquely in a tangential direction of the platen roller 7.

The recording sheet 2, after corrected its attitude by the stopper portion 339, is subjected to an increased feeding force. Therefore, the edge of the recording sheet 2 starts bending and goes forward to a sheet discharge outlet 8 beyond the stopper portion 339 when elastic force of the recording sheet 2 exceeds a predetermined value.

Meanwhile, the stationary clamp member 262, made of material of high rigidity, has one side confronting a circumferential surface of the platen roller 7, which is opposed to the circumferential surface wound by the recording sheet 2. The width of the stationary clamp member 262 is as wide as the distance between the right and left frames 17R, 17L. The stationary clamp member 262, fixed to the right and left frames 17R, 17L, has a substantially triangular cross section. A front edge of the stationary clamp member 262 is formed with a round surface 268 so as to guide the incoming or travelling recording sheet 2 smoothly. A portion provided inside the round surface 268 is a clamp surface 267 fitting to the clamp surface 263 of the movable clamp member 261. This clamp surface 267, an uniformly formed surface, can provide a uniform pressing force when clamped.

Furthermore, a portion provided inside the clamp surface 267 is a guide surface 273 which is stepped down to smoothly guide the recording sheet 2 when the recording sheet 2 is discharged. A bottom portion of the stationary clamp member 262 is provided with a guide surface 272 in opposed relation with the guide surface 273 for smoothly guiding the incoming recording sheet 2.

Figure 11:
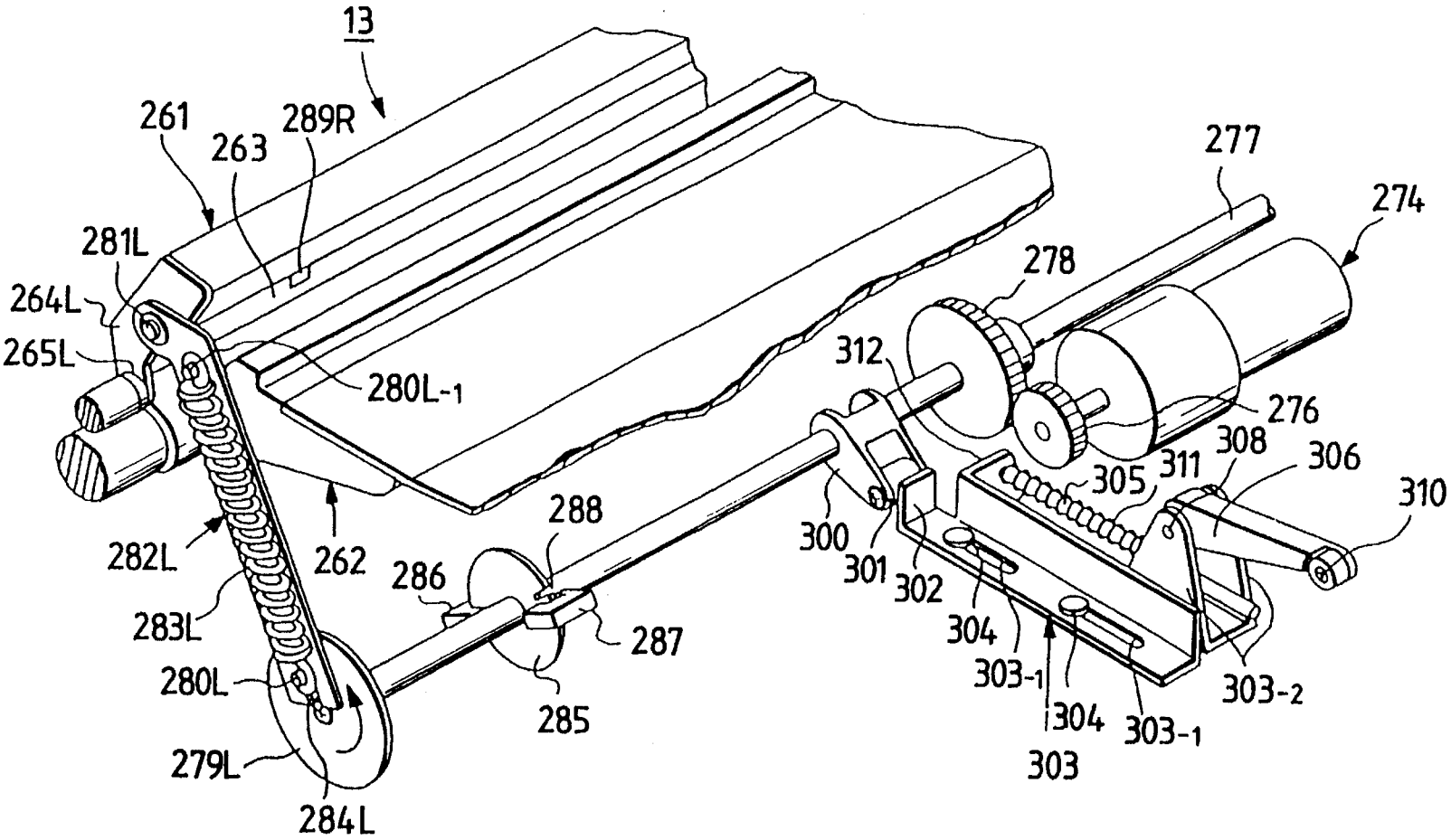
FIG. 11 is a schematic perspective view partly showing a driving mechanism of a movable clamp section.
Figure 12:
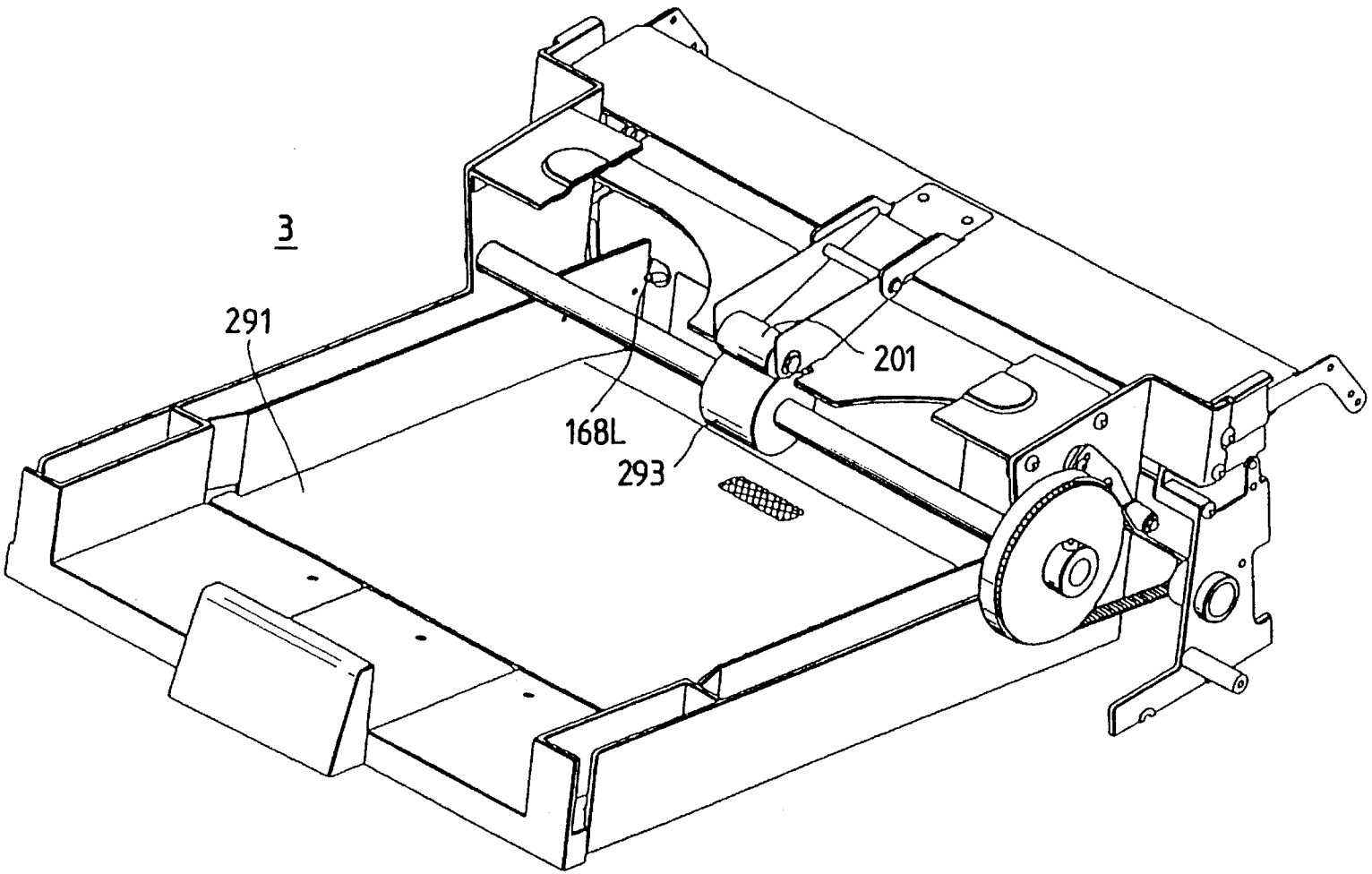
FIG. 12 is a schematic perspective view showing a recording sheet tray.

Next, opening/closing operation of the clamping mechanism 13 will be explained with reference to FIGS. 11 and 12. FIG. 11 is a perspective view schematically and partially showing the driving mechanism of the movable clamp member 261. FIG. 12 is a perspective view schematically showing a recording sheet tray 3. A geared motor 274 serves as a driving source for driving the movable clamp member 261. A driving force of the geared motor 274 is transmitted through gears 276, 278 to a shaft 277 at a reduced speed. The shaft 277 has both ends secured to disks 279R, 279L. Offset pins 280R, 280L are provided at positions offset from the centers of the disks 279R, 279L, respectively. These offset pins 280R, 280L are coupled into U-shaped kerfs 284R, 284L provided on the link members 282R, 282L at one end thereof, respectively.

Both ends of the link members 282R, 282L are pivotally supported by axes 281R, 281L of the plate members 264R, 264L provided at both ends of the movable clamp member 261, respectively. Pins 280R-1, 280L-1 of the link members 282R, 282L are connected through springs 283R, 283L to the offset pins 280R, 280L, respectively.

When the disks 279R, 279L are rotated in the counterclockwise direction by the geared motor 274, the offset pins 280R, 280L move upward in FIG. 11 in the kerfs 284R, 284L, and lift the link members 282R, 282L up, respectively. With this lift-up motion of the link members 282R, 282L, the movable clamp member 261 rotates in the counterclockwise direction about axes 265R, 265L toward its opened position. When the offset pins 280R, 280L reach the highest position, the movable clamp member 261 is fully opened.

If the offset pins 280R, 280L further rotate in the clockwise or counterclockwise direction from their highest position, the movable clamp member 261 comes close to the stationary clamp member 262. Before the offset pins 280R, 280L reach their lowest position, the movable clamp member 261 abuts the stationary clamp member 262. With further rotation, the springs 283R, 283L are expanded, thereby providing a pressing force given from the movable clamp member 261 to the stationary clamp member 262. When the offset pins 280R, 280L reach the lowest position, the pressing force becomes maximum.

A slit plate 285 and transmission sensors 286, 287 constitute a detecting mechanism for checking open/close condition of the movable clamp member 261. More specifically, a slit portion 288 is detected by the transmission sensor 286 in the maximum pressing condition, while the slit portion 288 is detected by the transmission sensor 287 in the fully opened condition.

In the fully opened condition of the movable clamp member 261, the stopper portion 339 positions just on the tangential line drawn from the pressing point of the platen roller 7 and the thermal head 91. In this condition, if the front end of the recording sheet 2 is inserted by later-described sheet feeding operation, reflection type photo sensors 289R, 289L provided along the clamp surface 261 detect the loading of the recording sheet 2.

On the other hand, the geared motor 274 qualifies as a driving source for pressing the recording sheets 2 against the feed/discharge roller 293; namely, the recording sheets 2 are pressed against the sheet feed/discharge roller 293. Then, the sheet feed/discharge roller 293 rotates to feed the recording sheet 2 inside the printer 1. In this manner, the geared motor 274 serves as a driving source for pressing the recording sheets 2 against the sheet feed/discharge roller 293.

The shaft 277 is provided with an arm 300 having a tip portion with a small roller 301. A follower 303 has an abutting surface 302 facing to this roller 301. This follower 303 can shift only one direction since its movement is restricted by a pair of elongated straight holes 303-1, 303-1 and pins 304, 304 inserted therein. The follower 303 has a side wall portion extending upward, one end of which is bent perpendicularly to form a flange portion 312. One end of a shaft 305 is fixed on this flange portion 312. The other end of the shaft 305 is loosely inserted into a hole 307 opened in the lower part of a sheet feed lever 306. (Refer to FIG. 4) A ring 305-1 is slidably engaged with the shaft 305. A compression spring 311 is interposed between the ring 305-1 and the flange portion 312. The sheet feed lever 306, having substantially L-shaped configuration, is pivotally supported through an axis 308 to a support portion 303-2. A small roller 310, provided on the upper end of the sheet feed lever 306, is brought into contact with the reverse surface of a bottom plate 291 of the recording sheet tray 3.

With such an arrangement, when the shaft 277 is rotated in the counterclockwise direction in FIG. 11 by the geared motor 274 to fully open the movable clamp member 261, the roller 301 mounted on the arm 300 pushes the follower 303 by the abutting surface 302. Therefore, the follower 303 slides and the sheet feed lever 306 connected to the follower 303 rotates in the counterclockwise direction. As a result, the roller 310 mounted on the sheet feed lever 306 pushes the bottom plate 291 upward.

When the movable clamp member 261 is fully opened, i.e. when the transmission sensor 287 detects the slit portion 288, the roller 310 can press the recording sheets 2 against the sheet feed/discharge roller 293 at the maximum pressure. This pressure is given by the compression spring 311.

The shaft 277 is rotatable in both clockwise and counter-clockwise directions. When shaft 277 is rotated in the clockwise direction, the roller 310 is disengaged from the abutting surface 302 of the follower 303. Therefore, only the movable clamp member 261 is opened.

In FIG. 2, the recording sheet tray 3 storing recording sheets 2 has an inside space allowing the uppermost recording sheet 2 to proceed forward and return backward for recording operations. More specifically, after one printing operation for one color is finished, the recording sheet 2 is reversely transported to the original start point to start the next printing operation for another color. The recording sheet tray 3 provides a space for receiving the recording sheet 2 coming back.

Figure 25:
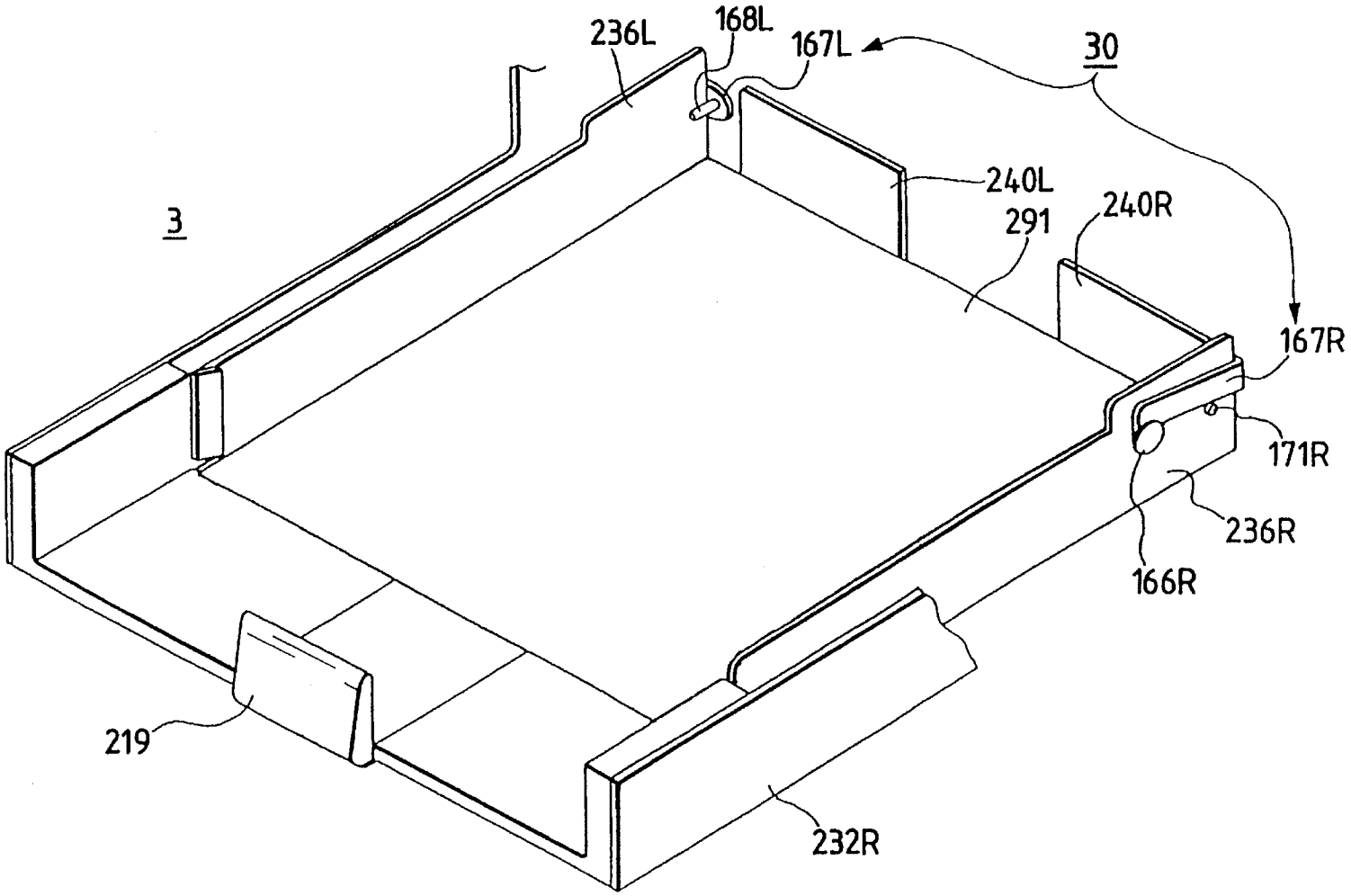
FIG. 25 is a perspective view showing a recording sheet tray.

FIG. 25 shows the detailed structure of the recording sheet tray 3. The recording sheet tray 3, whose shape is like a box, has the bottom plate 291 rotatable about an axis (not shown) so as to be swingable with respect to a recording sheet tray frame 232.

Width regulating plates 236R, 236L are provided in parallel with each other at both sides of the recording sheet tray 3 along sheet feeding direction. L-shaped separating pin levers 167R, 167L are provided at forward edges of the width regulating plates 236R, 236L in the sheet feeding direction, so as to be swingable about axes 166R, 166L provided on the width regulating plates 236R, 236L, respectively. Distal ends of these L-shaped separating pin levers 167R, 167L are located at the front edge of the recording sheet tray 3 so as to protrude inwardly from the width regulating plates 236R, 236L. On these distal ends of these L-shaped separating pin levers 167R, 167L, there are provided separating pins 168R, 168L, respectively, for separating the recording sheets 2 loaded. These L-shaped separating pin levers 167R, 167L and separating pins 168R, 168L are cooperative to constitute a separating mechanism section 30. The separating pins 168R, 168L are always urged downward due to their gravity. Stopper pins 171R, 171L are provided on the outside surface of the width regulating plates 236R, 236L to restrict the downward movement of the separating pin levers 167R, 167L.

Figure 26:
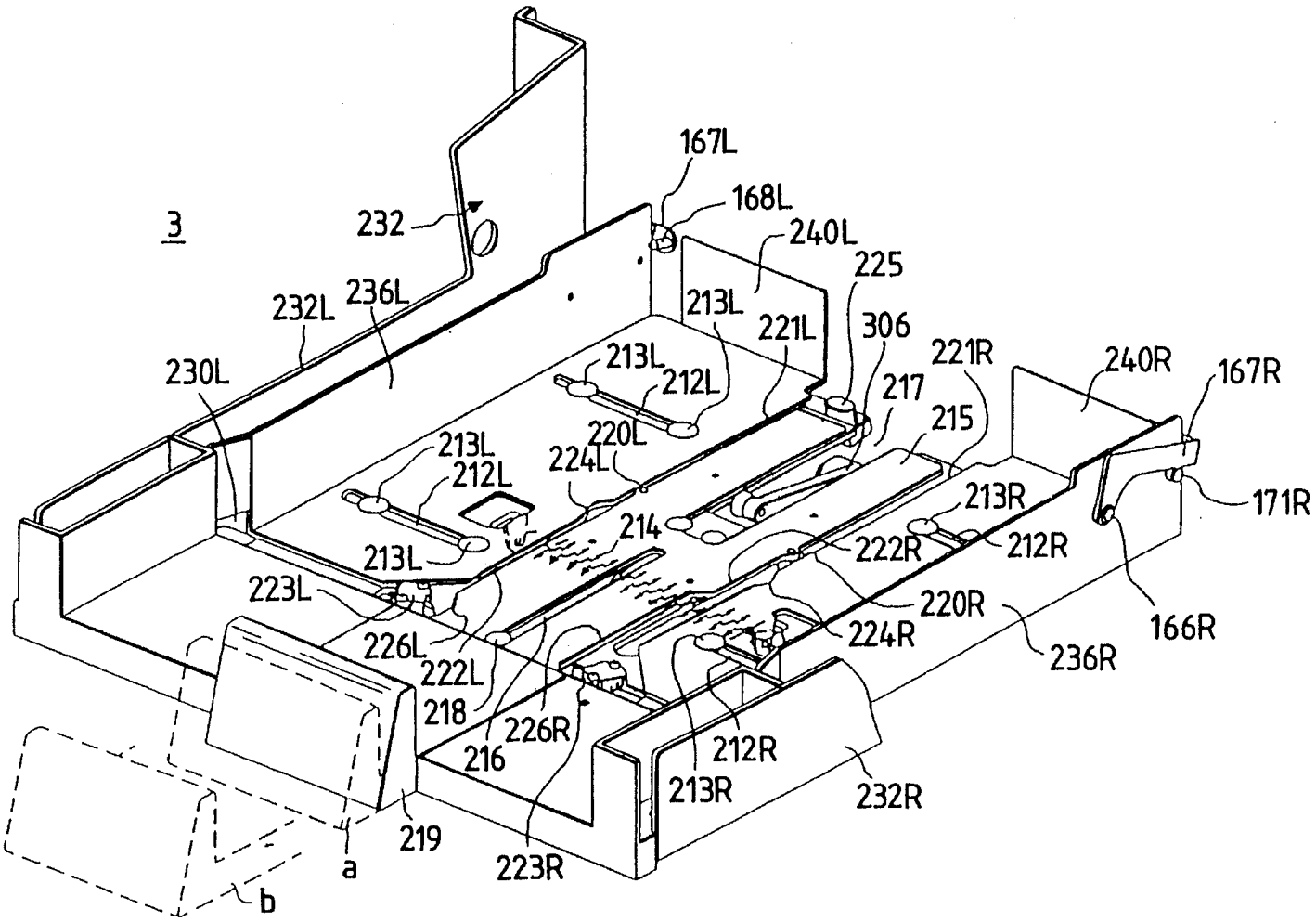
FIG. 26 is a perspective view showing an adjusting mechanism of the recording sheet tray.

The recording sheet tray 3 has flexibility of storing a plurality of kinds of recording sheets. A method of varying the largeness of the recording sheet tray 3 in accordance with the size of the recording sheet will be explained with reference to FIG. 26. This embodiment uses three kinds of recording sheets of A4 size (297×210 mm), Letter size (279,4 ×215,9 mm) and Legal size (355,6×215,9 mm). FIG. 26 shows a condition where the recording sheet tray is adjusted to the recording sheets of Letter size. Right and left width regulating plates 236R, 236L have elongated holes 212R, 212L on their bottom surfaces. These elongated holes 212R, 212L are guided by guide shafts 213R, 213L, respectively, so that the width regulating plates 236R, 236L can slide in the lateral direction. With this lateral sliding mechanism, the width regulating plates 236R, 236L take the outermost position for adjustment to the recording sheets of Letter size and Legal size, or take the innermost position for adjustment to the recording sheets of A4 size. A spring 214 is provided for always biasing the width regulating plates 236R, 236L inward. Front end regulating plates 240R, 240L are integrally formed with the width regulating plates 236R, 236L to regulate the front ends of loaded recording sheets.

A length regulating plate 215, provided in the center of the recording sheet tray 3, has an elongated hole 216 and an U-shaped kerf 217. A guide shaft 218 is coupled in the elongated hole 216 to allow the length regulating plate 215 to slide in the longitudinal direction, thereby fitting to each of Letter-, A4- and Legal-sized recording sheets. A rear end regulating member 219 is fixed at the rear end of the length regulating plate 215. This rear end regulating member 219 serves not only as means for regulating the rear ends of the recording sheets but as a grip or handle for sliding operation of the length regulating member 215.

An operation for changing positions of the width regulating plates 236R, 236L and the length regulating plate 215 will be explained hereinafter.

The length regulating plate 215 has rollers 220R, 220L rotatably supported at lateral edges thereof. These rollers 220R, 220L are always brought into contact with innermost edges 221R, 221L of the width regulating plates 236R, 236L. The edges 221R, 221L have recesses 224R, 224L. When the rollers 220R, 220L are received by these recesses 224R, 224L, the width between the width regulating plates 236R, 236L is varied.

The length regulating plate 215 has cam surfaces 222R, 222L at its lateral edges. These cam surfaces 222R, 222L have cutout portions 226R, 226L different in length with each other. Two switches (actuator switches) 223R, 223L are provided on the bottom surface of recording sheet tray frame 232. These switches 223R, 223L are turned on when pushed by the edges 221R, 221L of the width regulating plates 236R, 236L other than the cutout portions 226R, 226L.

The cutout portion 226L on the cam surface 222L has a length enough to keep a clearance between the length regulating plate 215 and the actuator of switch 223L when the rear end regulating member 219 is located at the position of FIG. 26 and is shifted rearward from this position to a position a. Meanwhile, the cutout portion 226R on the cam surface 222R has a length enough to keep a clearance between the length regulating plate 215 and the actuator of switch 223R when the rear end regulating member 219 is located at the position of FIG. 26 and is shifted rearward from this position to a position b.

The condition of FIG. 26, wherein the rear end regulating member 219 is inserted most deeply, corresponds to the recording sheets of Letter size (279.4×215.9 mm). In this condition, actuators of the switches 223R, 223L are spaced from the cam surfaces 222R, 222L due to existence of cutout portions 226R, 226L. Therefore, no switch is turned on. It means that it is found that the recording sheets 2 of Letter size are loaded from the fact that the switches 223R, 223L are both in OFF condition.

When the rear end regulating member 219 is pulled from the position of FIG. 26 to the position a, the rollers 220R, 220L are received in the recesses 224R, 224L. In this instance, the width regulating plates 236R, 236L move inward being urged by elastic force of the spring 214. Thus, the largeness of the recording sheet tray 3 fits to recording sheets of A4 size (297×210 mm). The switch 223L goes out of the region of the cutout portion 226L; therefore, the actuator of the switch 223L is turned on. Thus, it is possible to detect the recording sheets 2 of A4 size from the fact that only the switch 223L is in ON condition.

When the rear end regulating member 219 is fully pulled out, i.e. when the guide shaft 218 reaches the dead end of the elongated hole 216, the rear end regulating member 219 is located at a position b in the drawing. In this case, the rollers 220R, 220L go out of the recesses 224R, 224L against elastic force of the spring 214 and travel along the edges 221R, 221L of the width regulating plates 236R, 236L. It means that the width of the recording sheet tray 3 returns to Letter or Legal size (215.9 mm). The longitudinal length of the recording sheet tray 3 is identical with Legal size (355.6 mm). The switch 223R goes out of the region of the cutout portion 226R in this case; therefore, the actuator of the switch 223R is turned on. Thus, it is also possible to detect the recording sheets 2 of Legal size from the fact that both of the switches 223R, 223L are in ON condition. Until the rear end regulating member 219 reaches the position b in the drawing, the cutout portion 226R is spaced from the actuator of switch 223R; thus, it is judged that A4 size recording sheets are loaded in the recording sheet tray 3.

In this manner the largeness of the recording sheet tray 3 can be easily changed according to size of the recording sheets 2 to be loaded by simply pulling the lever (i.e. rear end regulating member) 219, because width adjustment of the recording sheet tray 3 is automatically done by the interaction between the rollers 220R, 220L and the recesses 24R, 224L. Detection of the recording sheet size—Letter, A4 and Legal sizes—can be easily done by two actuator switches 223R, 223L. That is, the embodiment of the present invention is far from complicated adjustment. When the rear end regulating member 219 is most deeply pushed, the size of the recording sheet tray 3 is automatically adjusted to be Letter size. When the rollers 220R and 220L are engaged with the recesses 224R, 224L, the size of the recording sheet tray 3 is automatically adjusted to be A4 size. When the rear end regulating member 219 is most pulled out, the size of the recording sheet tray 3 is automatically adjusted to be Legal size. Thus, complicated adjustment is no longer required. The cutout portions 226R and 226L are formed on the cam surfaces 222R and 222L so as to correspond to the size of the predetermined recording sheets. This arrangement allows detecting the presence of recording sheets having size smaller than that of the above predetermined recording sheets. Thus, it becomes possible to prevent the recording sheets whose size is smaller than that of the required recording region from being mistakenly loaded in the recording sheet tray 3.

A reflection type photo sensor 225 is provided near the front end of the recording sheet tray 3. A hole (not shown), confronting with this photo sensor 225, is provided on the bottom plate 291. These photo sensor 225 and the hole cooperatively detects presence of the recording sheet 2 in the recording sheet tray 3. It is needless to say that the combination of recording sheet sizes is not limited to the disclosed one.

In FIG. 3, a reference numeral 326 represents a sheet feeding guide (guide plate) which guides the recording sheet 2 separated by the separating mechanism section 30 to the platen roller 7. Detailed structure of this sheet feeding guide 326 will be explained with reference to FIG. 27.

Figure 27:
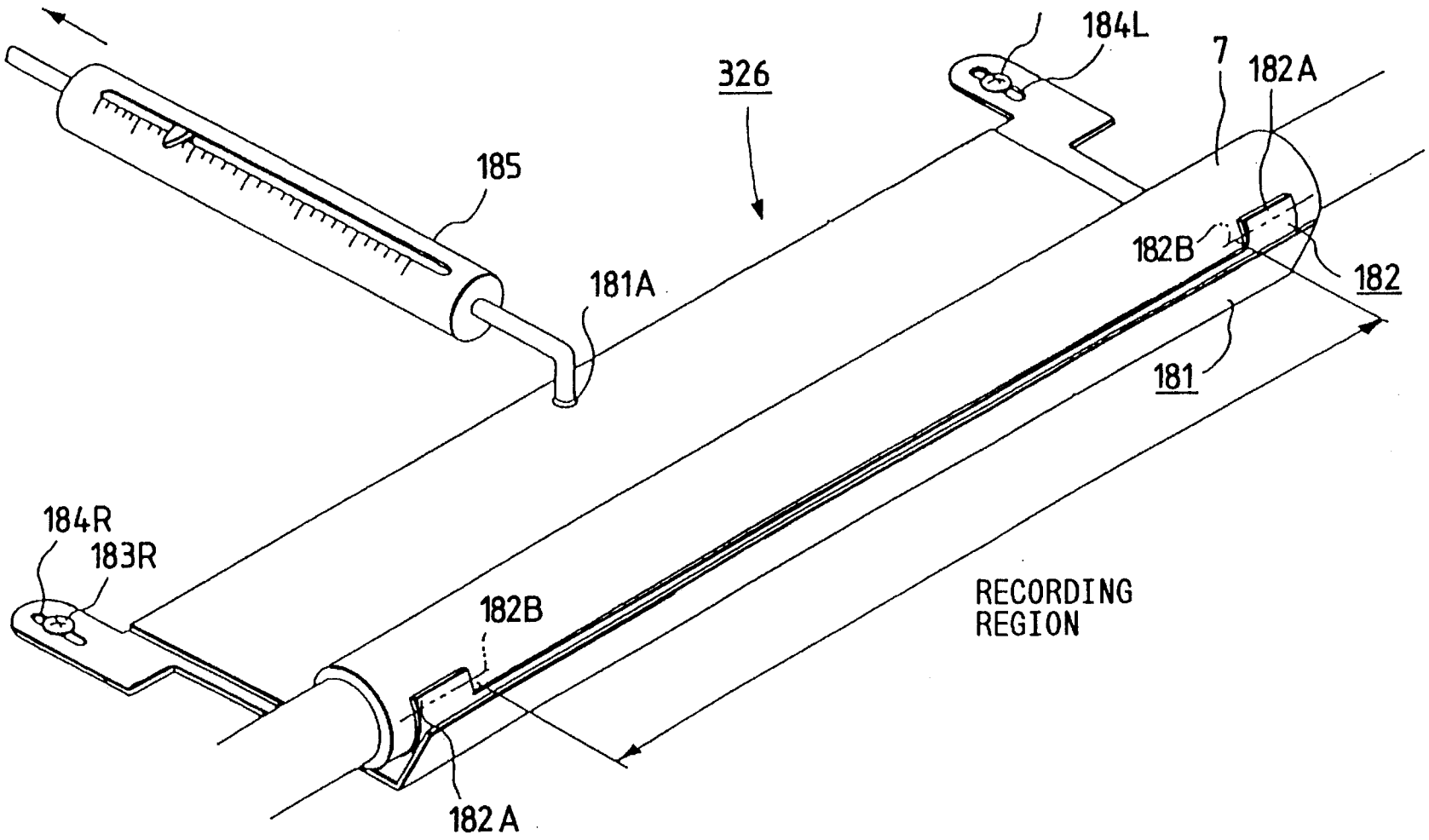
FIG. 27 is a perspective view showing a sheet feeding guide.

In FIG. 27, the sheet feeding guide 326 comprises a pressing spring 181 and an elastic member 182 having one end fixed to the pressing spring 181. Although the pressing spring 181 is fixed on the L-shaped stay 39 (refer to FIG. 3) by means of screws 183R, 183L, the pressing spring 181 can slide in the sheet feeding direction since elongated holes 184R, 184L allow the screws 183R, 183L to move therein. The pressing spring 181 extends horizontally beyond the platen roller 7 and rises upwardly to approach the thermal head 91. (Refer to FIG. 3) The elastic member 182 deforms elastically at the bent portion of the pressing spring 181.

The elastic member 182 has protruding portions 182A, 182A provided outside the predetermined recording region. These protruding portions 182A, 182A are brought into contact with the circumferential surface of the platen roller 7 at a line 182B. The position of line 182B is higher than the lowest end of the platen roller 7, and varies depends on deformation of the elastic member 182. Thus, the pressing force can be adjusted by simply sliding the pressing spring 181 in the sheet feeding direction.

Next, a method of adjusting the pressing force of the sheet feeding guide 326 will be explained with reference to FIG. 27. The pressing spring 181 has an adjusting hole 181A at a lateral center thereof. A tension gauge 185 or the like is engaged with this adjusting hole 181A. When the tension gauge 185 is pulled in a direction of an arrow in FIG. 27 with the screws 183R, 183L being loosened, the pressing spring 181 presses the platen roller 7 through the elastic member 182. When the tension gauge 185 reaches a predetermined value, the screws 183R, 183L are fastened tightly, thereby maintaining the pressing force to the platen roller 7 at a constant value. In this manner, the pressing force can be checked precisely by the tension gauge 185. As the adjusting hole 181A is provided at the center of the sheet feeding guide 326, the pressing force can be equally applied to right and left edges of the sheet feeding guide 326.

This adjustment can be done independently on the recording unit alone on which the sheet feeding guide 326 is installed; thus, it becomes possible to perform the adjustment simultaneously when the recording operation progresses.

With above arrangement, frictional force acting between the recording sheet 2 and the platen roller 7 can be adjusted so as to provide an adequate transportation force suitable for the recording sheet to be used. As a frictional coefficient between the elastic member 182 and the recording sheet 2 is fairly small compared with that between the platen roller 7 and the recording sheet 2, the recording sheet 2 is virtually transported by the rotation of the platen roller 7. Meanwhile, the transportation force acting between the platen roller 7 and the recording sheet 2 is fairly smaller than the clamping force acting between the movable clamp member 261 and the stationary clamp member 262. Therefore, even if the platen roller 7 is reversely rotated, the recording sheet 2 is firmly clamped between the movable clamp member 261 and the stationary clamp member 262, only causing slip against the platen roller 7. This pressing force should be determined by taking account of sheet pressure of the recording sheet 2, so that the front edge of the recording sheet 2 transported along the sheet feeding guide 326 can be smoothly inserted between the platen roller 7 and the elastic member 182.

Figure 28:
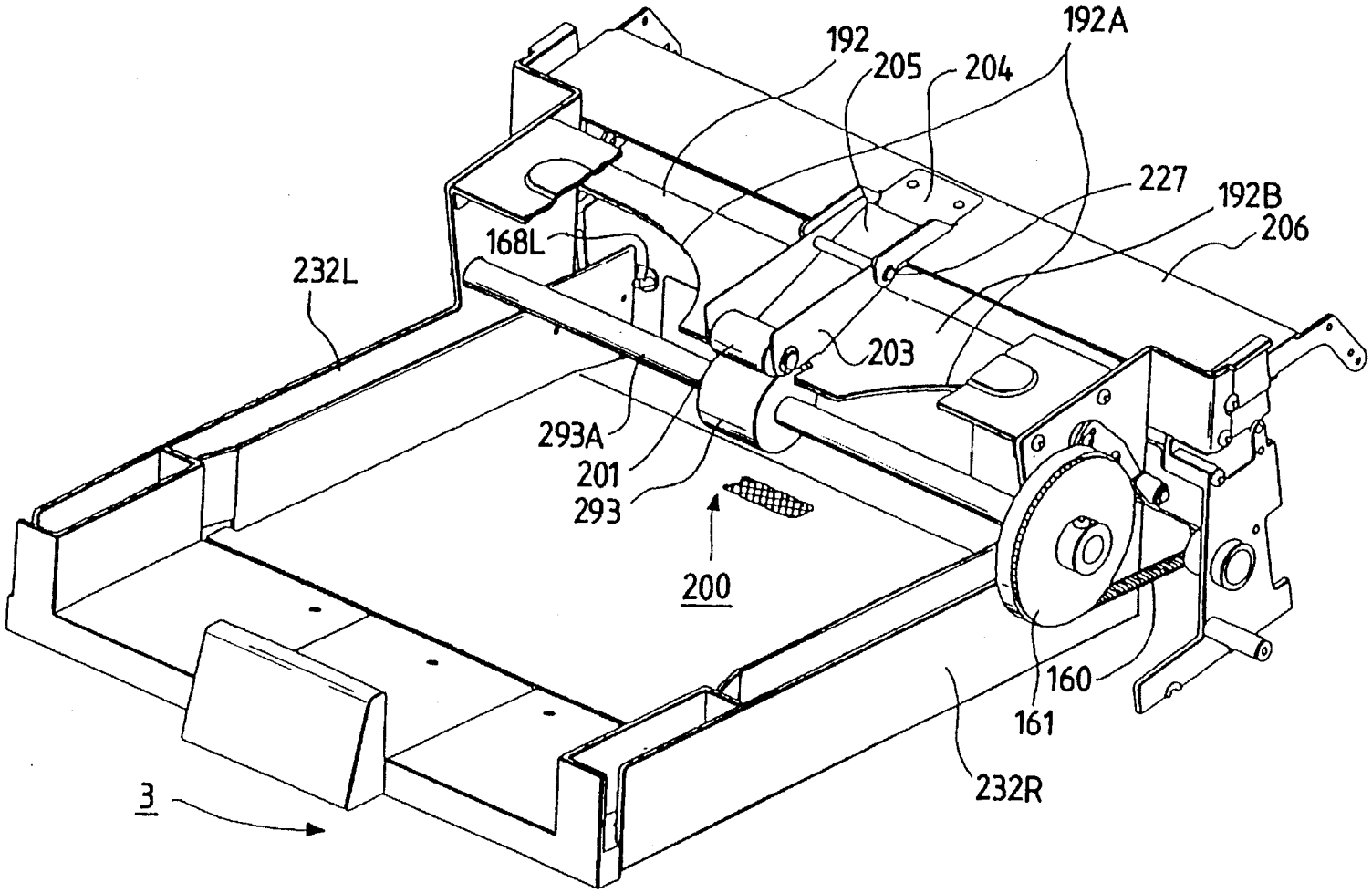
FIG. 28 is a perspective view showing the recording sheet tray and its vicinity.

In FIG. 28, a reference numeral 192 represents a sheet discharge guide plate 192 extending from the stationary clamp member 262 to the sheet feed/discharge roller 293. This sheet discharge guide plate 192 not only defines a sheet discharge path but defines an upper regulating plate of the sheet feeding path. As illustrated in FIG. 28, the sheet discharge guide plate 192 has cutout portions 192A, 192A at portions corresponding to the separating mechanism section 30. These cutout portions 192A, 192A are provided so as to avoid deflection of the recording sheet 2 occurring at both ends thereof. These cutout portions 192A, 192A provide sufficiently large deflection regions. The remaining portion of the discharge guide plate 192 serves as a guide surface 192B for guiding the recording sheet 2 to the sheet feed/discharge roller 293.

A reference numeral 201 represents a follower roller pressing the sheet feed/discharge roller 293, so as to give the sheet feed/discharge roller 293 a transportation force. The follower roller 201 and the sheet feed/discharge roller 293 cooperatively constitute a recording sheet transportation mechanism section 200. Hereinafter, this recording sheet transportation mechanism section 200 will be explained in detail with reference to FIG. 28.

In FIG. 28, the axis 293A of the sheet feed/discharge roller 293, supported on the recording sheet tray frame 232R, is securely connected to the pulley 181 provided outside the recording sheet tray frame 232R. This pulley 161 is connected through the timing belt 180 to the platen roller driving system. When the pulley 181 rotates, the sheet feed/discharge roller 293 secured to the axis 293A rotates correspondingly.

The follower roller 201 pressing the sheet feed/discharge roller 293 is supported by a follower roller arm 203 which is rotatable about an axis 227. The other end of this follower roller arm 203 has a lower surface serving as a flat spring abutting portion 205 which abuts to a flat spring 204. As the flat spring 204 disposed on a upper regulating plate 206 urges the flat spring abutting portion 205 upward, the follower roller 201 can press the sheet feed/discharge roller 293. The flat spring 204, being an elastic member made of metal or plastic resin or the like, has a bottom surface 204A confronting with the guide surface 192B of the sheet feed/discharge guide plate 192 and one end secured to the upper regulating plate 206 defining the sheet discharge path, as shown in FIG. 3. The flat spring 204 lifts up the follower roller arm 203, with its shape being bent downward.

Next, a series of recording operations of the printer 1 will be explained. First of all, the thermal head mechanism section 10 is located at the retracted position as illustrated in FIG. 6. Then, the cartridge 12 is loaded along the rails 24R, 24L. (Refer to FIG. 5) Thereafter, the thermal head mechanism section 10 is rotated and brought into contact with the platen roller 7 as shown in FIGS. 2 and 3. In this condition, the thermal head 91 is not yet pressed against the platen roller 7. The transfer sheet 11 is pulled out, in this condition, from the cartridge 12, and travels via the supply roll 25, the thermal head 91, the heat sink 92, the stay 87 and the wind roll 26.

Subsequently, the recording sheets 2 are loaded into the recording sheet tray 3. When the recording mode is selected, the geared motor 274 is actuated to drive the movable clamp member 261 to its open position. The small roller 310 of the sheet feed lever 306 pushes the bottom plate 291 upward, so that the recording sheets 2 accumulated on the bottom plate 291 are pressed against the sheet feed/discharge roller 293, as shown in FIG. 9. Under this condition, the platen roller 7 and the sheet feed/discharge roller 293 rotate in the counterclockwise direction.

Figure 29:
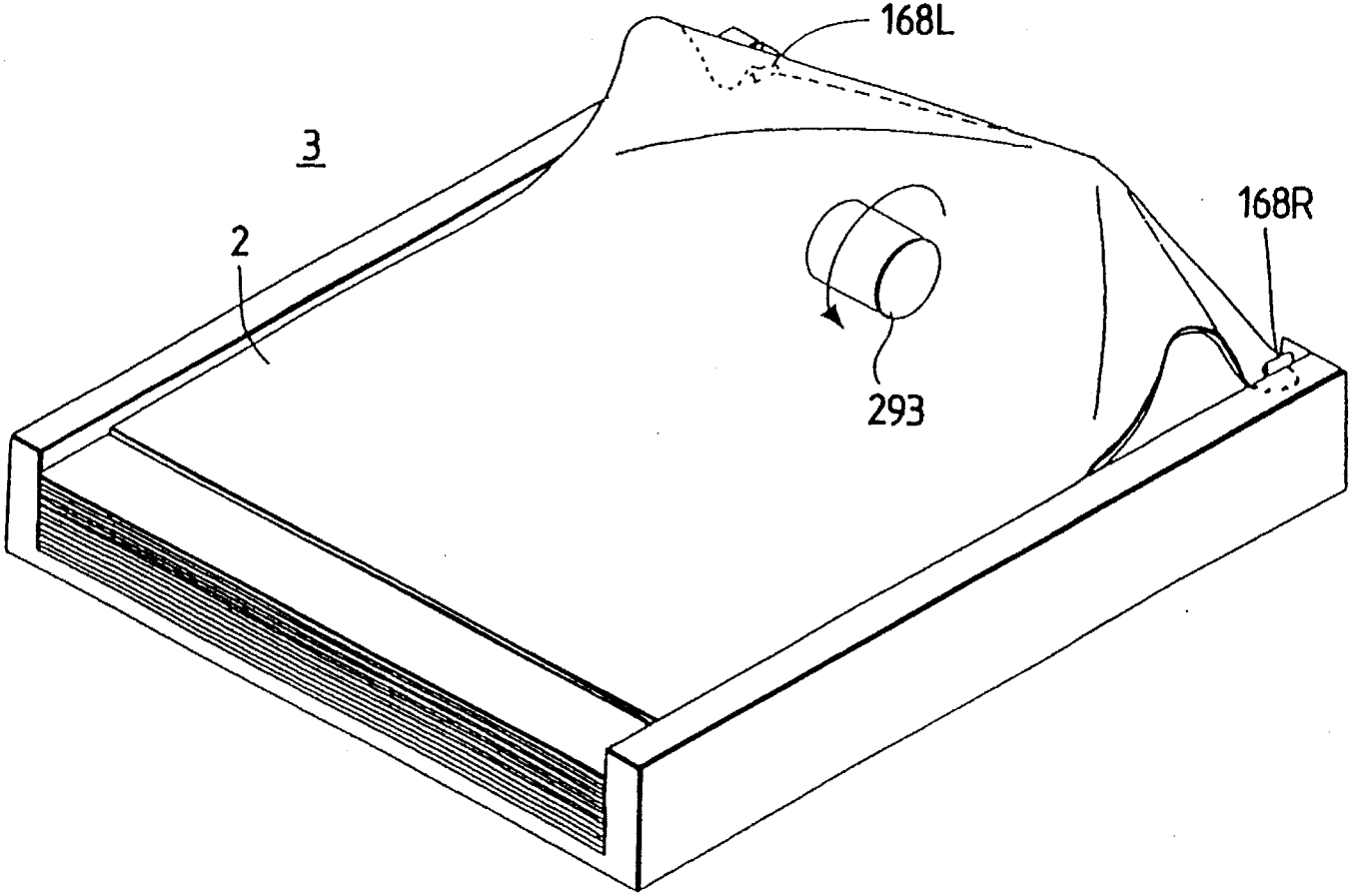
FIG. 29 is a view showing deflection occurring on the recording sheet.
Figure 30:
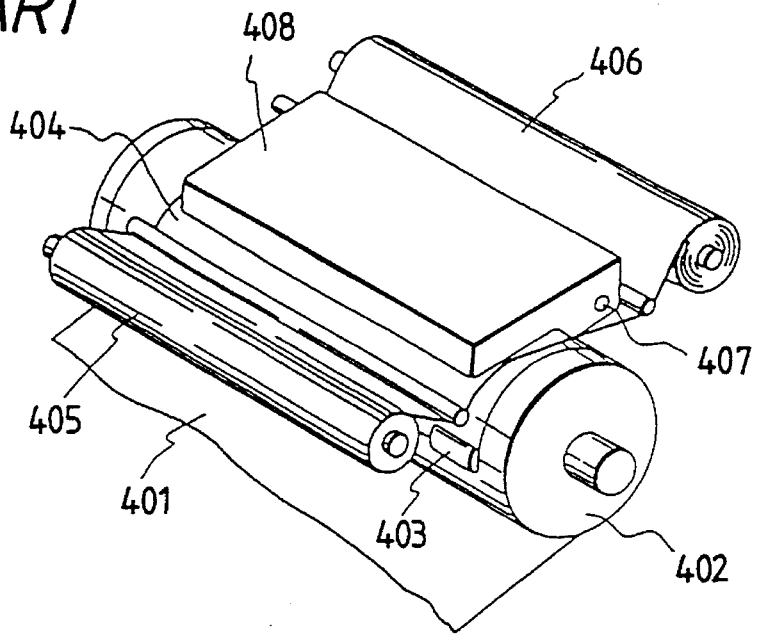
FIG. 30 PRIOR ART
FIG. 30 is a perspective view showing a conventional printer.
Figure 31:
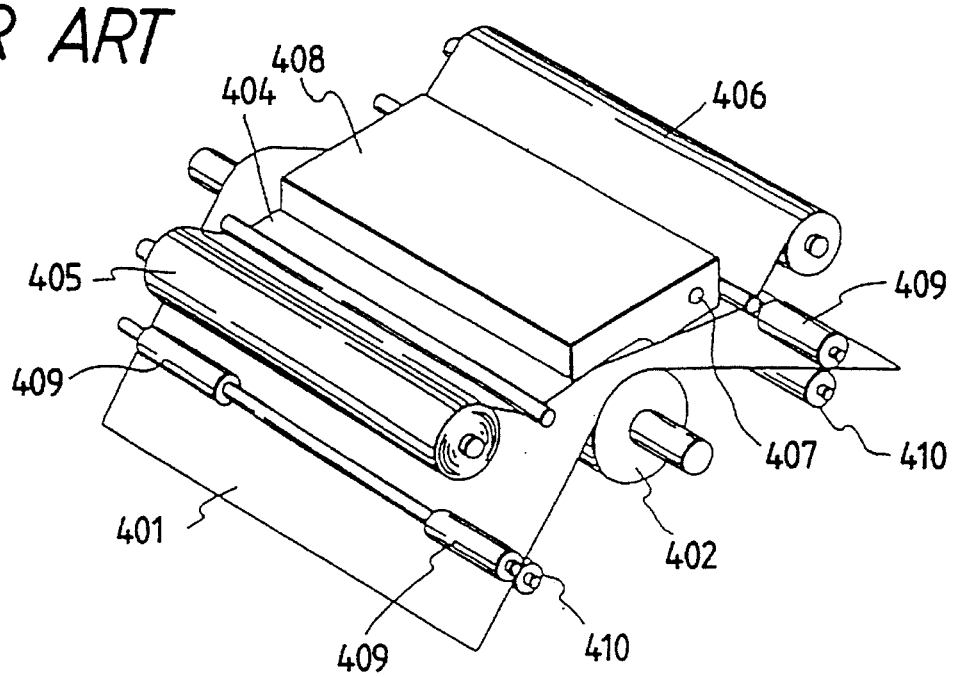
FIG. 31 PRIOR ART
FIG. 31 is a perspective view showing another conventional printer.
Figure 32:
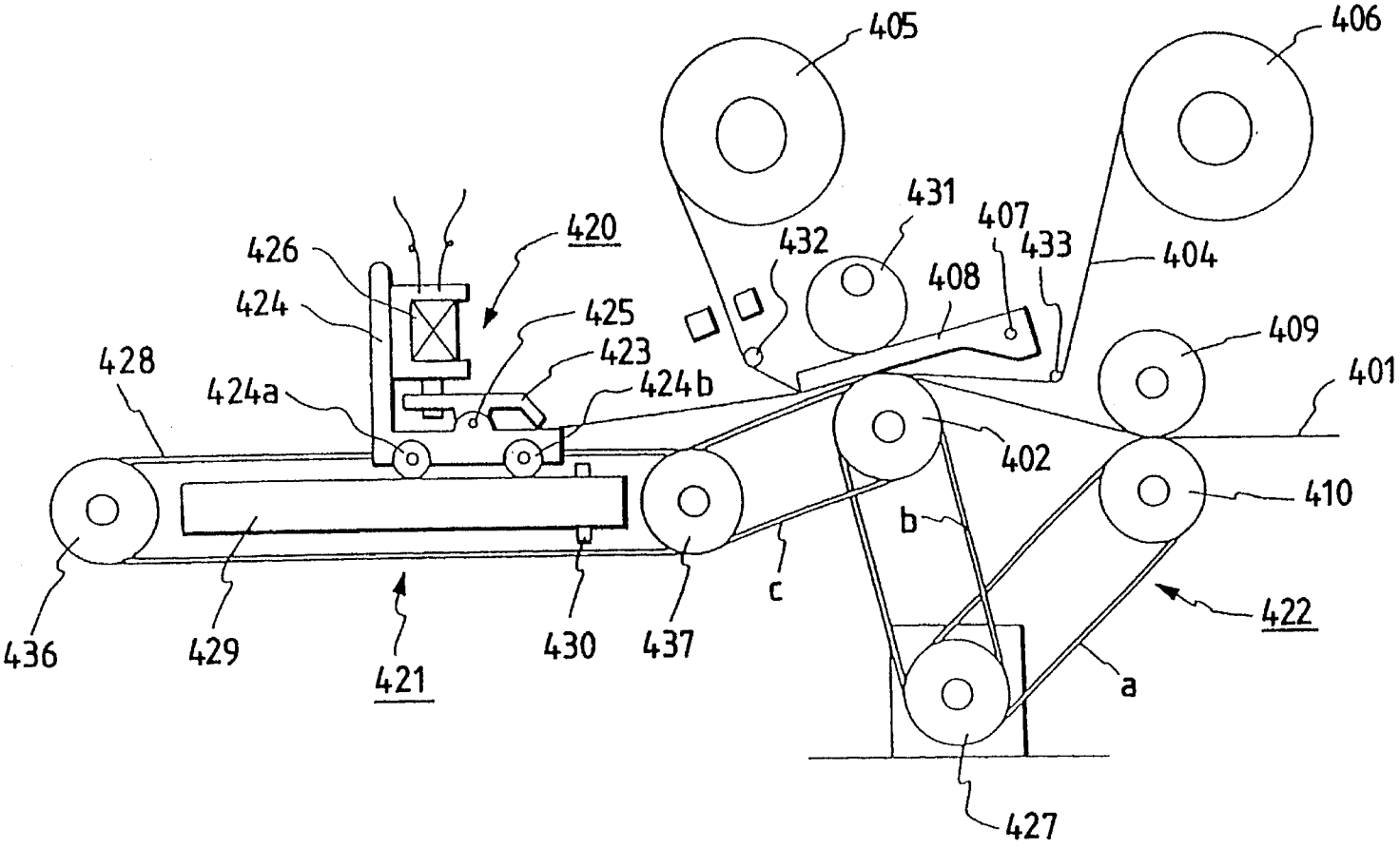
FIG. 32 PRIOR ART
FIG. 32 is a perspective view showing still another conventional printer.

The deflection of the uppermost recording sheet 2 in this condition is shown in FIG. 29, wherein large deflection occurs in both side edges of recording sheet in the vicinity of the sheet feed/discharge roller 293 rather than in the vicinity of the separating pins 168R, 168L. To prevent this deflection contacting with the sheet discharge guide plate 192, the cutout portions 192A, 192A are provided at both ends of the sheet discharge guide plate 192. (FIG. 28)

The deflection occurring on the recording sheet 2 during sheet feeding operation becomes large with increasing rigidity of the recording sheet 2. By enlarging the cutout portion 192A, the deflection region of the recording sheet 2 can be increased. Too much largeness of the cutout portion 192A will cause the recording sheet 2 hangs down at both ends thereof depending on the rigidity of the recording sheet 2. Therefore, the front end of the recording sheet 2, transported toward the sheet discharge outlet 8 (refer to FIG. 1), may be hooked by the axes 293A of sheet feed/discharge roller 293, resulting in trouble such as misdischarge or torn of the sheet 2. The largeness and shape of the cutout portions 192A, 192A, therefore, should be determined by taking account of rigidity of the recording sheet 2 to be used, so that the recording sheet 2 can be smoothly discharged.

When the uppermost recording sheet 2 is transported further being propelled by the rotation of sheet feed/discharge roller 293, deflection becomes so large that the front edge of the uppermost recording sheet 2 is released from the separating pins 168R, 168L. Thus, only one recording sheet 2 is taken out of the tray 3, and conveyed on the sheet feeding guide 326. The front edge of the recording sheet 2 passes through a clearance between the platen roller 7 and the thermal head 91 and reaches the stopper portion 339 of the movable clamp member 261. Even if the front edge of the recording sheet 2 deviated upward during transportation, the guide surface 272 of the stationary clamp member 262 corrects the position and attitude of the recording sheet 2. Thus, the recording sheet 2 is accurately guided to the clearance between the platen roller 7 and the thermal head 91.

When the recording sheet 2 reaches the stopper portion 339, the reflection type photo sensors 289R, 289L provided along the clamp surface 263 detect the loading of the recording sheet 2. In response to detection of the recording sheet 2 by the photo sensors 289R, 289L, the movable clamp member 261 is closed to firmly clamp the recording sheet 2 between the clamp surfaces 263, 267. In this instance, the bottom plate 291 swings downward, so that the recording sheets 2 are spaced from the sheet feed/discharge roller 293.

The stopper portion 339 is effective to correct the attitude of the recording sheet 2, because the front edge of the recording sheet 2 is surely adjusted by abutting the stopper portion 339 even if it is accidentally inclined during transportation. However, the recording sheet 2 may be inclined on the surface of the platen roller 7. In such a case, twist occurs on the surface of recording sheet 2 in the region between the platen roller 7 and the stopper portion 339.

To remove this twist, the stepping motor 150 (FIG. 24) is rotated in the reverse direction, thereby allowing the platen roller 7 to pull the recording sheet 2 so as to remove the twist or deflection. Since the clamp force of the clamp mechanism section 13 is set to be fairly larger than the transportation force of the platen roller 7, it is surely prevented that the recording sheet 2 is gotten out of the clamp mechanism section 13. Thus, the recording sheet 2 is arranged at right position along a tangential line connecting the round surface of the stationary clamp member 262 and the circumferential surface of the platen roller 7. In this case, the rotation amount of the stepping motor 150 can be controlled by a timer.

However, as the recording sheet 2 has elasticity, the reverse rotation of the platen roller 7 is not perfect in completely removing the deflection or eliminating inclined attitude of the recording sheet 2. Furthermore, in order to execute the recording operation of three kinds of colors Y, M and C, the recording sheet 2 is repeatedly subjected to reserving operation into the reservoir section 14 and backward transportation from the reservoir section 14. This will forcibly change the elasticity of recording sheet 2. As a result the recording start point will be offset slightly, causing dislocation of color images.

To resolve such problems, the present invention shifts the recording sheet 2 forward and backward plural times, before initiating the recording operation of first color (Y), not only to remove deflection and inclination of the recording sheet 2 but to stabilize (reduce) the elasticity of the recording sheet 2.

That is, the thermal head 91, supplied with no electric current, is brought into contact with the platen roller 7. The platen roller 7 is rotated in the forward direction (sheet sending-out direction) by an amount of several tens of lines. Thereafter the platen roller 7 is rotated in the backward direction by an amount larger than the forward feeding amount. For example, one cycle of the platen roller rotation is a combination of a forward rotation of 30 lines and a backward rotation of 50 lines. This cycle is repeated several times so that the deflection and inclination of the recording sheet 2 are completely removed and the elasticity of the recording sheet 2 is stabilized. Above feeding amount and the number of repetition should be determined based on the quality of recording sheet 2. For example, when the recording sheet 2 has small elasticity, the line numbers of forward and backward rotations can be reduced and the cycle number can be also reduced. On the other hand, when the recording sheet 2 has large elasticity, the line numbers of forward and backward rotations and the cycle number need to be increased. Thus, it becomes possible to prevent dislocation of color images due to repeated forward and backward feeding operations of the recording sheet 2.

When the above operation of removing deflection or inclination and stabilizing the rigidity of the recording sheet is finished, the thermal head 91 is pressed against the platen roller 7 and records color ink onto the recording sheet 2 from the transfer sheet 11 while the recording sheet 2 is reserved in the reservoir section 14, as shown in FIG. 4.

During recording operation, a pair of detecting devices 23, 23 provided in the sheet feeding path detect presence of the rear end of the recording sheet 2. The detecting devices 23, 23 send their detecting result to the control section of the printer 1, so that the recording operation can be stopped before the transfer sheet 11 is brought into contact with the platen roller 7 in the even that the loaded recording sheet 2 is not long enough.

When the recording operation of first color is finished, the thermal head 91 is released from the platen roller 7. Then, the platen roller 7 rotates in the reverse direction until the recording sheet 2 returns the recording start point again. The recording start point is common to all the color inks used. In this case, the recording sheet 2 comes back along the sheet feeding path until the rear end of the recording sheet 2 reaches an X position (FIG. 2) beyond the sheet feed/discharge roller 293.

The present invention determines size and shape of the travelling path of the recording sheet 2 from the view points of compactness, strength, and simpleness. A length from the sheet feed point of the recording sheet 2 to the recording start point is designed to be fairly short. More specifically, a sheet transportation path defined between the sheet feed/discharge roller 293 and the clamp 13 mechanism section 13 is shorter in length than the length of the recording sheet 2. An exclusive escape path is not provided specially, because the sheet feeding path can be commonly used for such a path.

The platen roller 7 is reversely rotated as much as the number of lines rotated forward for recording of Y color, rewinding the recording sheet 2 reserved in the reservoir section 14. As deflection of the recording sheet 2 is not completely removed yet, further rotation is added to the platen roller 7, thereby removing the deflection of the recording sheet 2. The rotation number of the platen roller 7 is equal to an integer not less than 1. Assuming that the pulleys 153 and 122 have teeth numbers of $P_1$ and $P_2$, and the timing belts 154 and 157 have $T_1$ and $T_2$, respectively, the following equation (1) defines the rotation number of the platen roller 7. (Refer to FIG. 24)

$$LCM\left(\frac{LCM(P_1, T_1)}{P_1}, \frac{LCM(P_2, T_2)}{P_2}\right) \quad (1)$$

where, $LCM(N_1, N_2)$ represents a least common multiple of integers $N_1$ and $N_2$.

For example, when a reduction ratio of the pulley 152 to the pulley 153 is ½ and a reduction ratio of the pulley 155 to the pulley 122 is ⅕, teeth numbers of the pulleys 152, 153, 155 and 122 are defined as $M_1$, $2M_1$, $M_2$ and $5M_2$, respectively. Furthermore, if the timing belts 154, 157 have teeth numbers of $3M_1$, $6M_2$, respectively, the above equation (1) gives 6 as a rotation number given to the platen roller 7.

If reverse rotation is applied to the platen roller 7 in accordance with the equation (1), the relationship among the platen roller 7, the stepping motor 150, the pulleys 152, 153, 155, 122, and the timing belts 154, 157 at the recording start point for second color is perfectly identical with that for first color. Namely, teeth of the timing belts 154, 157 always mesh with the same teeth of the pulleys 152, 153 and 155, 122, respectively. One rotation of the platen roller 7 makes an advance of integer lines. One rotation of the stepping motor 150 generates integer steps. Therefore, the relationship between a certain point on the platen roller 7 and a certain point on the output shaft 151 of the stepping motor 150 remains unchanged in each of first and second colors.

Subsequently, it becomes possible to eliminate positional deviation of color images due to irregularity of teeth and eccentricity of platen roller.

Operation for removing deflection is carried out each time before restarting the recording operation for another colors M and C.

When the recording operation is finished, the movable clamp member 261 is moved to the retracted position shown in FIG. 9. Therefore, the front end of the recording sheet 2 is released from the clamp mechanism section 13 and the platen roller 7 conveys the recording sheet 2 toward the sheet discharge outlet 8. In this case, the recording sheets 2 stored in the recording sheet tray 3 are not pressed against the sheet feed/discharge roller 293. As the transportation path of the recording sheet 2 is substantially V-shaped path bent at the platen roller 7, the front end of the recording sheet 2 tends to shift upward due to restoring force. However, the upper regulating plate 208 guides the recording sheet 2 toward the sheet discharge outlet 8 together with the flat spring 204. When the recording sheet 2 is further transported, both ends of the recording sheet 2 cause downward deflection due to gravity at the time when the recording sheet 2 passes the cutout portions 192A, 192A of the sheet discharge guide 192, while the central portion of the recording sheet 2 is lifted upward. However, the flat spring 204, provided at the center of this transportation path with curvature extending downward, restricts the upward deflection of the recording sheet 2. Thus, the central portion of the recording sheet 2 is guided between the sheet feed/discharge roller 293 and the follower roller 201. Thereafter, the recording sheet 2 is discharged out of the printer 1 by the rotation of the sheet feed/discharge roller 293.

The display panel 19, provided on the upper surface of the printer 1, indicates kind of transfer sheet detected by the switches 34R, 34L of the transfer sheet discriminating means, and several warnings based on the signals of the devices 23, 23, or others.

As this invention may be embodied in several forms without departing from the spirit of essential characteristics thereof, the present embodiments as described are therefore intended to be only illustrative and not restrictive, since the scope of the invention is defined by the appended claims rather than by the description preceding them, and all changes that fall within metes and bounds of the claims, or equivalence of such meets and bounds are therefore intended to be embraced by the claims.

What is claimed is:

1. A color printer comprising:

a line thermal head;

a platen roller rotatable in both forward and reverse directions for feeding a recording sheet forward when the platen roller is rotated in the forward direction and said line thermal head is pressed against said platen roller, and for returning the recording sheet backward when the platen roller is rotated in the reverse direction and the line thermal head is released from said platen;

recording sheet pressing means, independent of said line thermal head, for pressing the recording sheet against said platen roller, said recording sheet pressing means comprising a pressing spring plate and an elastic member, said pressing spring plate applying a pressing force to the recording sheet through said elastic member; and a sheet transportation path for guiding the recording sheet to said platen roller;

said pressing spring plate of said recording sheet pressing means extending in a predetermined direction so as to serve as a guide member defining said sheet transportation path, and a fixing position of said pressing spring plate being adjustable with respect to said platen roller, so that the pressing force applied by said pressing spring plate to the recording sheet through said elastic member is quantitatively adjustable.

2. A color printer in accordance with claim 1, wherein said elastic member has a frictional coefficient against said recording sheet that is smaller than a frictional coefficient of said platen roller against the recording sheet, and wherein said elastic member presses the recording sheet at a region laterally outside a predetermined recording region of the recording sheet.

3. A recording apparatus comprising:

recording sheet tray means for storing recording sheets;

sheet feed roller means for pressing an uppermost recording sheet stored in said recording sheet tray means and feeding the uppermost recording sheet from said recording sheet tray means to a platen roller;

clamp means for clamping a leading edge of a recording sheet loaded on said platen roller at a predetermined fixed position of said recording apparatus;

driving means for rotating said platen roller so as to cause a reciprocative movement of the loaded recording sheet in forward and backward directions each time one of a plurality of color images is printed on said loaded recording sheet, without shifting the leading edge of said loaded recording sheet, thereby realizing sequential recording of plural color images onto the loaded recording sheet;

wherein said clamp means includes a movable clamp section and a stationary clamp section, and a first drive mechanism for moving said movable clamp section from a clamp position, where said movable clamp section is pressed against said stationary clamp section, to a retracted position where said movable clamp section is released from said stationary clamp section, and a second drive mechanism for pressing and releasing said sheet feed roller means against and from the recording sheets stored in said recording sheet tray means, said first drive mechanism being linked and synchronously driven with said second drive mechanism.

4. A recording apparatus in accordance with claim 3, wherein said first and second drive mechanisms are actuated by a same motor.

5. A recording apparatus in accordance with claim 3, wherein said first and second drive mechanisms are driven for positioning said movable clamp section at said retracted position when said sheet feed roller means is pressed against said recording sheets stored in said recording sheet tray means, and for positioning said movable clamp section at said clamp position when said sheet feed roller means is released from said recording sheets stored in said recording sheet tray means during recording operations, said movable clamp section positioned at said retracted position when said sheet feed roller means is released from the recording sheets stored in said recording sheet tray means during a discharge operation of the loaded recording sheet from said platen.

6. A recording apparatus comprising:

a cartridge accommodating a supply roller and a wind roller cooperatively winding a transfer sheet;

a line thermal head mechanism including a pressing mechanism, for pressing and releasing a line thermal head to and from a platen roller at a predetermined position adjacent to said platen roller, and a holding mechanism for holding said line thermal head;

rotating means for rotating said line thermal head mechanism section from said predetermined position to a retracted position when said cartridge is removed from said recording apparatus;

a first gear train constituting a rewind mechanism section for rewinding the transfer sheet from said wind roller to said supply roller when said line thermal head mechanism is retracted;

a second gear train constituting a wind mechanism section, connected through a torque limiter to a drive shaft of a motor, for winding said winding roller; and connecting means for connecting a gear of said rewind mechanism section to a gear of said drive shaft of said motor in response to a movement of said rotating means, when said line thermal head mechanism section is rotated from said predetermined position to said retracted position.

7. A color printer comprising:

recording sheet tray means for storing recording sheets;

sheet feed roller means for pressing an uppermost recording sheet stored in said recording sheet tray means and feeding the uppermost recording sheet from said recording sheet tray means to a platen roller;

clamp means for clamping a leading edge of a recording sheet loaded on said platen roller at a predetermined fixed position of said color printer;

driving means for rotating said platen roller so as to cause a reciprocative movement of the loaded recording sheet in forward and reverse directions each time one of a plurality of color images is printed on the loaded recording sheet, without shifting the leading edge of the loaded recording sheet, thereby realizing sequential recording of plural color images onto the loaded recording sheet;

pressing means, operating after said clamp means clamps the leading edge of the recording sheet loaded on said platen roller, for pressing a line thermal head against said platen roller when said line thermal head is deactivated, said driving means rotating said platen roller so as to cause plural reciprocative movements of the recording sheet before initiating recording operations, each of said plural reciprocative movements corresponding to a forward rotation of said platen roller corresponding to predetermined lines and a reverse rotation of said platen roller travelling a path longer than that of said forward rotation of said platen roller.

8. A color printer in accordance with claim 7, wherein, after finishing a recording operation for one color, said driving means reversely rotates said platen roller as much as a forward sheet feeding amount for said one recording operation, and further reversely rotates said platen roller by an integer number of rotations.

9. A recording apparatus comprising:

recording sheet tray means for storing recording sheets;

sheet feed roller means for pressing an uppermost recording sheet stored in said recording sheet tray means and feeding the uppermost recording sheet from said recording sheet tray means to a platen roller;

clamp means for clamping a leading edge of a recording sheet loaded on said platen roller at a predetermined fixed position of said color printer;

driving means for rotating said platen roller so as to cause a reciprocative movement of the loaded recording sheet in forward and reverse directions each time one of a plurality of color images is printed on the loaded recording sheet, without shifting the leading edge of the loaded recording sheet, thereby realizing sequential recording of plural color images onto the loaded recording sheet;

a speed-reduction mechanism interposed between said platen roller and a motor, said speed-reduction mechanism having a reduction ratio of a reciprocal of a positive integer more than 1, wherein said speed-reduction mechanism comprises large and small toothed pulleys and a timing belt entrained between said pulleys, a ratio of said timing belt to said small pulley in teeth number is a positive integer more than 1;

said platen roller is reversely rotated, after finishing one recording operation for one color, as much as a forward sheet feeding amount for said one recording operation, and is further reversely rotated by the rotation number defined by $$LCM\left(\frac{LCM(P_1, T_1)}{P_1}, \frac{LCM(P_n, T_n)}{P_n}\right)$$

where, $LCM(N_1, N_2)$ represent a least common multiple of integers $N_1$ and $N_2$, $P_n$ represent a teeth number of said large pulley and $T_n$ represents a teeth number of said timing belt, and n represents the number of sets of pulleys and a timing belt.

10. A color printer comprising:

recording sheet tray means for storing recording sheets;

separating pins at both sides of said recording sheet tray means for separating an uppermost recording sheet of the recording sheets from said recording sheet tray means, said separating pins located at a leading edge of said recording sheet tray means in a sheet feeding direction;

a single sheet transportation roller for feeding the uppermost recording sheet to a sheet feeding path by imparting a transporting force to the uppermost recording sheet to make said separating pins separate the uppermost recording sheet, and for discharging a recording sheet on a sheet discharge path to an outside of said color printer, said sheet discharge path being above said sheet feeding path; and a single guide plate comparting said sheet feeding path and said sheet discharge path, said single guide plate having cutouts at portions just above said separating pins.

11. A color printer comprising:

recording sheet tray means for storing recording sheets;

sheet feed roller means for exerting pressure on an uppermost recording sheet stored in said recording sheet tray means and feeding the uppermost recording sheet from said recording sheet tray means to a platen roller;

clamp means for clamping a leading edge of a recording sheet loaded on said platen roller at a predetermined fixed position of said color printer;

driving means for rotating said platen roller so as to cause a reciprocative movement of the loaded recording sheet in forward and backward directions each time one of a plurality of color images is printed on the loaded recording sheet, without shifting the leading edge of the loaded recording sheet, thereby implementing sequential recording of plural color images onto the loaded recording sheet;

follower roller means for pressing said sheet feed roller means;

a guide plate for guiding the recording sheet to a contact point between said follower roller means and said sheet feed roller means; and a flat elastic member exerting a pressing force on said follower roller means, said flat elastic member having one surface confronting said guide plate to define a sheet discharge path therewith.

12. A color printer comprising:

a platen roller;

a thermal head fixed to a heat sink and configured to be pressed to and released from said platen roller;

a transfer sheet and a recording sheet positioned between said thermal head and said platen, thereby performing a recording operation of color images by pressing of said thermal head to said platen roller;

a gear having a female screw portion at a center thereof, said gear positioned behind said heat sink;

a motor rotating said gear;

a pressing member having a male screw portion engageable with said female screw portion of said gear, said pressing member moving said thermal head toward said platen roller in response to a rotation of said gear; and a spring member provided between said pressing member and said heat sink;

whereby said gear is rotated by said motor to move said pressing member so as to cause said pressing member to press said heat sink via said spring member, thereby pressing said thermal head to said platen roller.

13. A color printer comprising:

recording sheet tray means for storing recording sheets;

sheet feed roller means for exerting pressure on an uppermost recording sheet stored in said recording sheet tray means and feeding the uppermost recording sheet from said recording sheet tray means to a platen roller;

clamp means for clamping a leading edge of a recording sheet loaded on said platen roller at a predetermined fixed position of said color printer;

driving means for rotating said platen roller so as to cause a reciprocative movement of the loaded recording sheet in forward and backward directions each time one of a plurality of color images is printed on the loaded recording sheet, without shifting the leading edge of the loaded recording sheet, thereby implementing sequential recording of plural color images onto the loaded recording sheet;

a thermal head rotatable about bearing means, so as to be pressed against or released from said platen roller with a transfer sheet and the loaded recording sheet between said thermal head and said platen roller; and said bearing means including a steel ball, spring means for biasing said steel ball toward said thermal head, and a supporting hole provided on said thermal head for receiving said steel ball.

14. A color printer comprising:

recording sheet tray means for storing recording sheets;

sheet feed roller means for exerting pressure on an uppermost recording sheet stored in said recording sheet tray means and feeding the uppermost recording sheet from said recording sheet tray means to a platen roller;

clamp means for clamping a leading edge of a recording sheet loaded on said platen roller at a predetermined fixed position of said color printer, said clamp means including a movable clamp section and a stationary clamp section;

driving means for rotating said platen roller so as to cause a reciprocative movement of the loaded recording sheet in forward and backward directions each time one of a plurality of color images is printed on the loaded recording sheet, without shifting the leading edge of the loaded recording sheet, thereby implementing sequential recording operations for recording plural color images onto the loaded recording sheet;

a first drive mechanism for moving said movable clamp section from an engaged clamp position, wherein said movable clamp section is pressed against said stationary clamp section, to a retracted clamp position wherein said movable clamp section is released from said stationary clamp section, and a second drive mechanism for pressing and releasing said sheet feed roller means to and from the recording sheets stored in said recording sheet tray means, linking means for linking said first drive mechanism and said second drive mechanism to each other to be synchronously driven by a same motor, said linking means linking said first and second drive mechanisms so that during recording operations said movable clamp section is positioned at said retracted position when said sheet feed roller means is pressed against the recording sheets stored in said recording sheet tray means, and said movable clamp section is positioned at said engaged clamp position when said sheet feed roller means is released from the recording sheets stored in said recording sheet tray means, and so that, during an operation of discharging the loaded recording sheet from said platen, said movable clamp section is positioned at said retracted position when said sheet feed roller means is released from the recording sheets stored in said recording sheet tray means.

* * * * *